US010772788B2

(12) United States Patent
Kapec et al.

(10) Patent No.: US 10,772,788 B2
(45) Date of Patent: Sep. 15, 2020

(54) ROLLATOR

(71) Applicants: Jeffrey Kapec, Westport, CT (US); Jacob Turetsky, Brooklyn, NY (US); Yukiko Naoi, New York, NY (US); Johnathan Thayer, Greenwood Lake, NY (US); Phillippe D. Katz, Lawrence, NY (US); Paul Reamey, Brooklyn, NY (US)

(72) Inventors: Jeffrey Kapec, Westport, CT (US); Jacob Turetsky, Brooklyn, NY (US); Yukiko Naoi, New York, NY (US); Johnathan Thayer, Greenwood Lake, NY (US); Phillippe D. Katz, Lawrence, NY (US); Paul Reamey, Brooklyn, NY (US)

( * ) Notice: Subject to any disclaimer, the term of this patent is extended or adjusted under 35 U.S.C. 154(b) by 0 days.

(21) Appl. No.: 16/350,353

(22) Filed: Nov. 7, 2018

(65) Prior Publication Data

US 2019/0240106 A1 Aug. 8, 2019

Related U.S. Application Data

(60) Provisional application No. 62/582,588, filed on Nov. 7, 2017.

(51) Int. Cl.
*A61H 3/04* (2006.01)

(52) U.S. Cl.
CPC ..... *A61H 3/04* (2013.01); *A61H 2003/046* (2013.01); *A61H 2201/0107* (2013.01);
(Continued)

(58) Field of Classification Search
CPC ..... A61H 3/04; A61H 2003/046; A61H 2201/1633; A61H 2201/0107; A61H 2201/0161
See application file for complete search history.

(56) References Cited

U.S. PATENT DOCUMENTS 2,872,967 A * 2/1959 Kirkpatrick ..... A61H 3/04 297/5
5,772,234 A * 6/1998 Luo ..... A61G 5/00 280/47.38

(Continued)

*Primary Examiner* — Erez Gurari
(74) *Attorney, Agent, or Firm* — Gipple & Hale; John S. Hale

(57) ABSTRACT

A rollator designed to provide low-radius rotational mobility while a user is engaged in motion with a foldable and height adjustable frame allowing a user to have a natural full gait. The foldable frame has an angled upright U-shaped main frame section and a base U-shaped frame section mounted to the angled upright U-shaped frame and a U-shaped intermediate frame section mounted to the angled U-shaped upright frame section and the base U-shaped frame section. A moveable seat assembly is slideably mounted to the U-shaped support assembly to assume desire positions. A pair of rear wheels are mounted to the frame and a pair of front wheels are mounted to yoke mechanisms which are mounted on the frame. A brake assembly including brake levers are mounted to the frame, the brake assembly being operatively connected to the pair of rear wheels to brake the rear wheels with each of the brake levers being adapted to transfer braking force from the user hand grip lever to the rear wheels.

19 Claims, 42 Drawing Sheets

(52) U.S. Cl.
CPC ..... *A61H 2201/0161* (2013.01); *A61H 2201/1633* (2013.01)

(56) References Cited

U.S. PATENT DOCUMENTS 5,904,168 A * 5/1999 Alulyan ..... A61H 3/00 135/65
6,371,142 B1 * 4/2002 Battiston ..... A61H 3/04 135/66
6,494,469 B1 * 12/2002 Hara ..... A61H 3/04 135/67
7,179,200 B1 * 2/2007 Wu ..... A61G 5/10 135/67
7,669,863 B2 * 3/2010 Steiner ..... A61G 5/14 280/250.1
9,808,394 B1 * 11/2017 Jiang ..... A61H 3/04
10,174,932 B2 * 1/2019 Rosenblum ..... H05B 37/0236
2003/0070702 A1 * 4/2003 Ownes ..... A61H 3/00 135/74
2004/0104559 A1 * 6/2004 Chen ..... A61H 3/04 280/642
2004/0245737 A1 * 12/2004 Hallgrimsson ..... A61G 5/08 280/87.01
2007/0233403 A1 * 10/2007 Alwan ..... A61B 5/1038 702/33
2008/0084690 A1 * 4/2008 Rappl ..... F21V 21/0832 362/184
2009/0033052 A1 * 2/2009 Bradshaw ..... A61H 3/04 280/87.021
2009/0278325 A1 * 11/2009 Geels ..... A61H 3/04 280/5.28
2009/0310364 A1 * 12/2009 Turner ..... A61H 3/04 362/253
2010/0318005 A1 * 12/2010 Amonette ..... A61H 3/008 601/23
2012/0205882 A1 * 8/2012 Staggs ..... A61G 5/1002 280/30
2013/0062848 A1 * 3/2013 Huang ..... A61G 5/08 280/87.021
2013/0062864 A1 * 3/2013 Huang ..... A61H 3/04 280/650
2013/0106070 A1 * 5/2013 Woo ..... A61H 3/00 280/29
2013/0113187 A1 * 5/2013 Willis ..... A61H 3/04 280/649
2013/0181489 A1 * 7/2013 Serhan ..... A61H 3/04 297/129
2013/0292916 A1 * 11/2013 Nabeta ..... A61H 3/04 280/47.371
2014/0084559 A1 * 3/2014 Fang ..... A61H 3/04 280/47.38
2014/0125037 A1 * 5/2014 Andersen ..... A61H 3/04 280/639
2014/0319792 A1 * 10/2014 Miller ..... A61H 3/04 280/87.041
2015/0048598 A1 * 2/2015 Freeman ..... A61H 3/04 280/639
2015/0173994 A1 * 6/2015 Chen ..... A61H 3/04 280/639
2015/0216757 A1 * 8/2015 Powell ..... A61H 3/04 280/657
2016/0106617 A1 * 4/2016 Wobith ..... A61H 3/04 280/643
2016/0287465 A1 * 10/2016 Rabin ..... B60L 15/30
2017/0174190 A1 * 6/2017 DeBrock ..... B60T 7/105
2017/0326019 A1 * 11/2017 Bramsiepe ..... A61H 3/04
2017/0352288 A1 * 12/2017 Weffers-Albu ..... G09B 19/003
2018/0021205 A1 * 1/2018 DeBrock ..... B62L 3/06 135/85
2018/0028392 A1 * 2/2018 Bisceglia ..... A61H 3/04
2019/0009758 A1 * 1/2019 Liu ..... A61G 5/101
2019/0029915 A1 * 1/2019 Brockway ..... A61H 3/04
2019/0151185 A1 * 5/2019 Kirschey ..... A61H 3/04
2019/0209418 A1 * 7/2019 VanAusdall ..... A61H 3/04
2019/0240106 A1 * 8/2019 Kapec ..... A61H 3/04

* cited by examiner

FIG 26
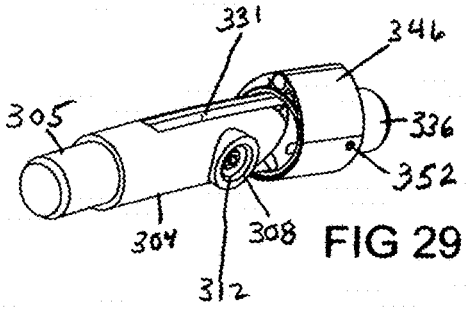
FIG 29
FIG 25
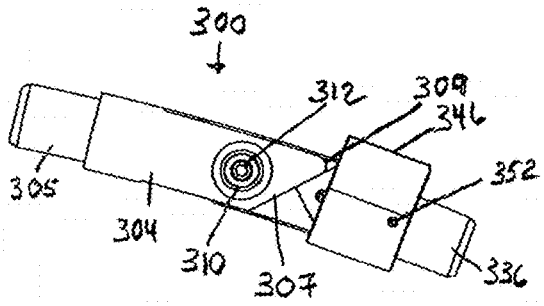
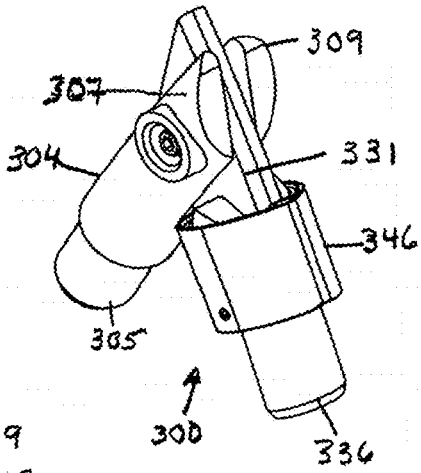
FIG 28
FIG 27
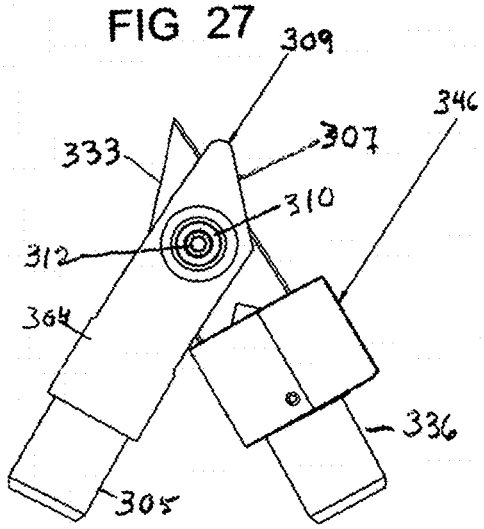
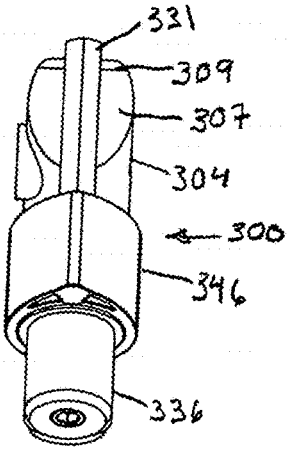

FIG. 48
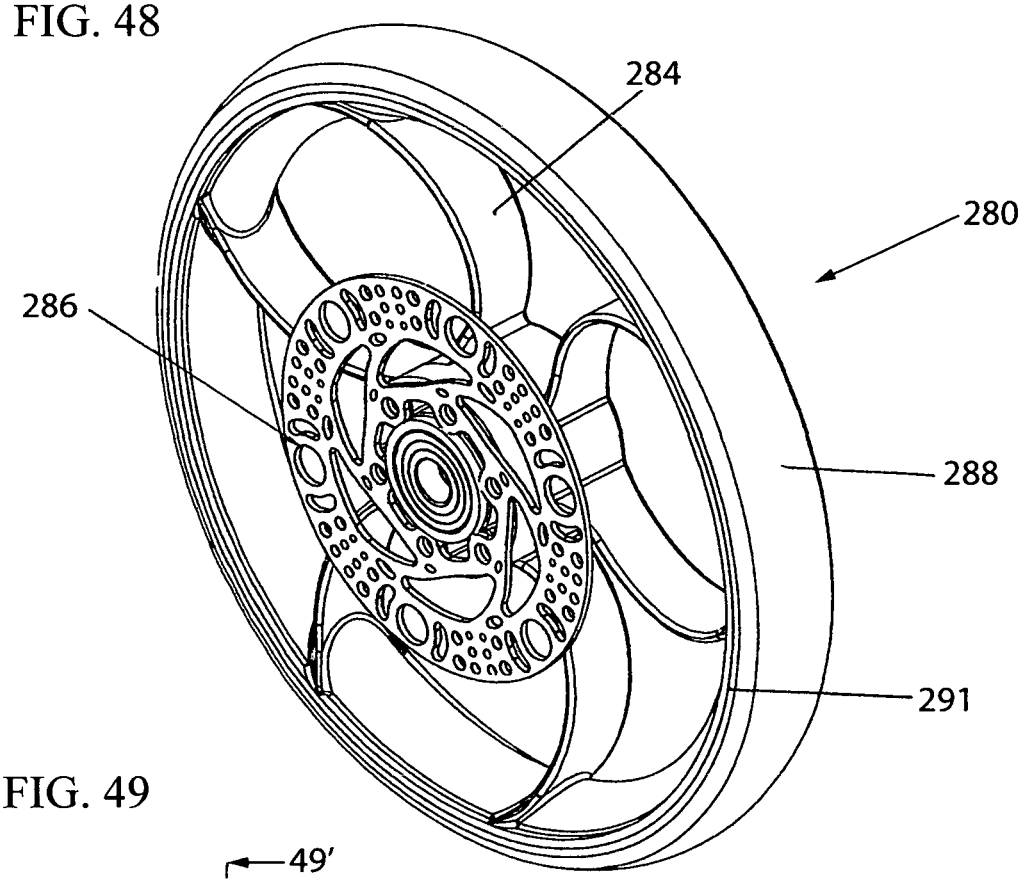
FIG. 49
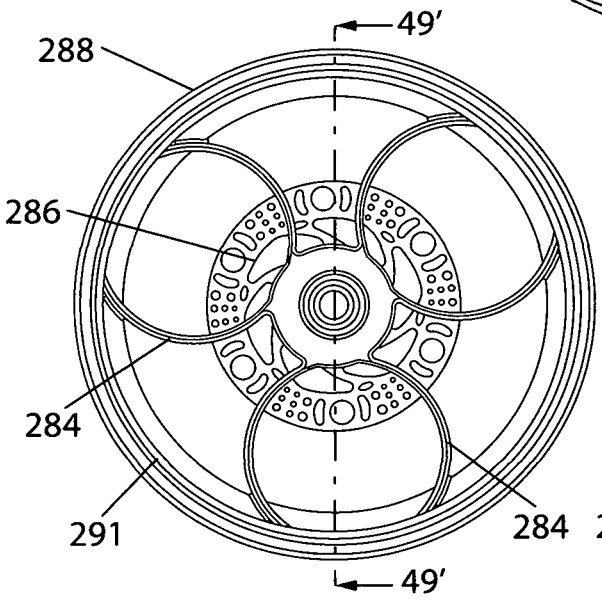
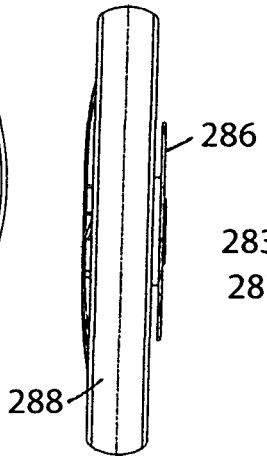
FIG. 50
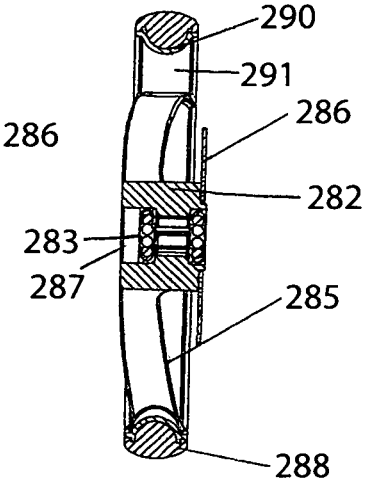
FIG. 51

ROLLATOR

RELATED APPLICATIONS

This is a utility patent application claiming priority and benefit from U.S. Provisional Patent Application No. 62/582,588 filed Nov. 7, 2017.

STATEMENT REGARDING FEDERALLY SPONSORED RESEARCH OR DEVELOPMENT

Not applicable.

REFERENCE TO SEQUENCE LISTING, A TABLE OR A COMPUTER PROGRAM LISTING COMPACT DISC APPENDIX

None.

BACKGROUND OF THE INVENTION

1. Field of Invention

The present invention is directed to a wheeled mobility-assistance device and more particularly to a foldable, height adjustable rollator which allows the user to have full gait when standing upright and is provided with a plurality of hand brakes, each of which when activated locks the rear wheels simultaneously.

2. Description of the Prior Art

There are numerous examples of products designed and manufactured for people who suffer with mobility/walking problems. The disability that is experienced may be minor and easily managed or major to the individual significantly affecting balance, stability, strength, range of motion, endurance, etc. People may cope with one specific annoyance, but a significant number of persons are seriously affected by one or multiple disabilities that compromise their mobility. Such disability issues include rheumatoid arthritis, arthritis in the knee joint, orthopedic impairment of the lower extremities, stroke, chronic injury of back and neck, cerebrovascular disease, Parkinson's disease, to list just a few of the conditions that impede mobility. Usually patients who suffer from arthritis of the knee joint also have significant wasting of thigh muscles. The cause of this muscle wasting can be explained by the fact that such individuals decrease their activity due to knee pain. They use their thigh muscles less often and try to put less strain on them. As a result the muscles become weaker and thinner. Weak muscles can't support the body weight adequately. Muscles of the thigh and buttock both take part in the standing up process. The quadriceps muscle of the thigh receives the most strain when standing up.

The range of impairments that affect walking are more common with aging, each affecting an individual's unique struggle with mobility and a need for walking support, balance and assistance. In many cases people are able to manage these problems and be mobile with the assistance of a walker. A basic walker limits the speed and transition of a user's walking gait to a slow deliberate step by step process, which is different from normal walking.

A wheeled walker (also called rollator) is well-known in the art as an improvement to the earlier walker and cane mobility aids and is a popular mobility assistance vehicle for the mobility impaired. The advantages of the wheeled walker are known to include smoother and more comfortable movement along even surfaces without requiring the user to lift or slide the walking aid along.

The addition of wheels to improve the mobility of the walker introduces the disadvantages of instability and user safety as well as impairing the full gait of the user.

A rollator provides fluid mobility compared to a walker along with enhanced mobility, increased support and encourages walking with a normal gait.

There is also a subset of people that have no adverse disability but would like to extend their range of walking endurance and add convenience to their daily activities. For this subset there is a latent need for a device that becomes a personal mobile assistant enabling the user to: go food shopping in a supermarket, walk to the gym or to the physical therapy location with a gear bag, transport things from store to home, spend a day in a museum, take a long walk on the deck of a cruise ship, spend a day at the mall, walk to a beautiful location, sit down/observe, and so on.

This subset of users may need some additive support but they principally want to benefit from additional freedom, to move about longer distances with faster mobility or perhaps exercise over distance and be able to transport personal items in a mobile carrying device that looks stylish, innovative, active and intelligent.

Walking with a full range gait coincides with normal bipedal walking physiology. Gait locomotion involves the entire body. The body's center of gravity is located at the hips, as balance starts there as does the walking motion. To attain a normal gait cycle a person should be standing upright in a vertical upright posture.

Normal walking involves the lower extremities and trunk for propulsion as well as balance and stability. The faster the speed of travel, the more the body engages the upper extremities and trunk for propulsion, balance, and stability.

In the human bipedal mobility system, three major joints of the lower body and pelvis work in concert as the muscles and momentum propels the body forward. The degree in which the body's center of gravity moves during the forward gait cycle defines walking efficiency. The body's center of balance moves side to side and up and down during gait but the axis of the spine remains upright.

While rollators or similar walking aids are helpful and enable walking mobility, these devices also create unintentional constraints with posture and gait cycle. The hands and arms of the user are extended forward relative to the torso; the hips, upper legs and knees no longer maintain a vertically stacked alignment as the spine is angled forward rather than positioned vertical to the ground plane and the pelvis is offset away from the arms and hands. The range of motion of the upper legs is impeded by the support structure (seat and or traverse frame member) of the rollator. In the standard rollator framework, a person's balance is offset and the gait cycle is constrained from enacting a full range of motion.

Almost all of the rollators on the market today have two brake handles which are independent. The dual handle configuration requires balanced hand force applied simultaneously to two brakes with left and right hands. If one hand is stronger than the other the braking force will be uneven resulting in turning and uneven tracking of the rollator. In many cases, the aged cannot apply the same hand strength on both the left and right side. In some users one hand may be significantly compromised. For those users, the user must rely on one hand for all tasks that require grip strength.

In addition to the problems noted above, there is a need to illuminate the ground or floor areas at twilight, night or in heavily shaded areas and to measure the distance traveled so that the user can meet physical therapy requirements.

Many practitioners have suggested further improvements to mitigate these added disadvantages. For example, U.S. Pat. No. 4,907,794, issued Mar. 13, 1990 discloses a foldable rolling walker having a high crossbar for easier walking convenience, height adjustable handles centered over offset wheels for greater stability and lockable pivoting front wheels and reversible brakes. Other similar improvements made to wheeled walkers include folding mechanisms, user-controlled wheel brakes and larger wheel sizes to improve stability and user safety. U.S. Pat. No. 7,001,313, issued Feb. 21, 2006 discloses a rollator that has four large pneumatic tires, with its rear tires being larger than the front tires, to facilitate safer movement over rough terrain while U.S. Pat. No. 9,173,802, issued Nov. 3, 2015 discloses a collapsible wheeled walker with large wheels and a folding mechanism for convenient storage.

U.S. Pat. No. 6,378,663 issued Apr. 30, 2002 is directed toward a brake mechanism for a walker. The brake mechanism is operated by handles which manipulate a brake cable which releases the wheel. An intermediate turning block connects the brake handle cables and activates the brake mechanism.

Some practitioners propose improving the walker mobility by adding upper body support means for supporting the user's forearms, hands or shoulders, to improve user comfort and posture. For example, U.S. Pat. No. 5,657,783, issued Aug. 19, 1997 discloses accessory forearm rests that may be mounted to any conventional invalid walker, preferably disposed above the normal hand-grips to provide added upper body support.

Likewise, U.S. Pat. No. 9,585,807, issued Mar. 7, 2017 discloses a collapsible upright wheeled walker with adjustable arm rests that support a user upper-body weight to facilitate upright gait and provide mobility for a wide range of mobility-impaired individuals. The apparatus can also include mechanical brakes and a pair of handles.

The present invention overcomes these problems and deficiencies and the same are solved by this invention in the manner described below.

SUMMARY OF THE INVENTION

The present invention changes the physical and spatial relationship of the user and the rollator enabling a full gait cycle to be used.

The present invention enhances control, stability, balance, standing posture, gait cycle, turning, and ease of use. The frame geometry, structure, and spatial relationships of the rollator's frame have been reconfigured so that a full upright user standing posture could be attained along with a full walking gait cycle. The full gait cycle is thus not impeded by obstructions caused by either the frame or a seat mounted to the frame. The user is positioned in the center of the open frame so that the turning axis is aligned approximately with the vertical axis of the user.

The present inventive rollator is designed to maintain stable and erect body posture of a user and allow a full gait of the user. It is constructed with a sectional frame having a U-shaped upright main section, a U-shaped lower base section mounted to the upright section and an intermediate support section mounted to the upright main section and the lower base section. A plurality of rear wheels are mounted to the upright support section and a plurality of pivotable front wheels are mounted to the lower base frame section. A brake assembly is mounted to the frame for braking the rear wheels and a pivotable seat assembly is mounted to the frame for retraction of the seat into the frame during walking or opening the seat in the frame for use by the user.

When the present invention rotator device is turned (changes direction) it rotates about the vertical axis of the user so that the user is always supported and is walking within the wheel base rather than being outside or behind the wheel base. In addition, an upright walking "push bar/resting bar" or accessory rail is incorporated into the frame structure. The upright walking push bar enhances upright posture so that users may support themselves with the hand grips or alternatively in any comfortable grip position along the upright push bar. It also enables the user to lean and rest on the bar.

The present invention solves the upright wheeled walker stability problem by providing a wheel suspension assembly that, for the first time, suppresses lateral motion from wheel load fluctuations created by user when stepping while also dampening wheel shocks caused from engaging irregular terrain.

The invention couples both rear wheel brakes to the action of a single lever with balanced brake force applied to both wheels. Each of the two rear wheel are evenly braked with a single handed squeeze of the brake lever. The brake lever may be mounted to either left or right side depending on preference of user or mounted on both sides of the rollator. This provides a meaningful functional opportunity for stroke patients who may have issues with the strength or coordination of one side vs the other side.

A therapist activated tensioner can be used to modulate controlled brake resistance on the rear wheels to manage/limit the user's speed or effort. Continuous controlled resistance may be utilized by the user through the brake system to reduce velocity when moving downhill over a distance. Controlled resistance may also be applied to the wheels to satisfy a different objective. Continuous controlled resistance may be applied by a physical therapists and utilized to make the user apply additional muscular force to push (walk with) the upright mobility device.

The invention can be provided with an odometer which measures walking distance for objective documentation and charting user improvements over time. This allows physical therapists to apply walking objectives that change over time. The physical therapist may need quantified measurement of distances travelled over time for clinical documentation and patient charting. The odometer provides a practical and simple means to obtain this data and use that data over time to see trending and changes.

Integrated lighting is mounted on the invention for downward, and forward projecting illumination. Two types of illumination are available in the rollator to enable the user to see in various dark environments. One dark environment may be outdoors when ambient lighting is insufficient to provide clear visualization forward or downward while walking on a travelled pathway; examples may be a sidewalk, a dirt path, a country road, a backyard, etc. A second dark environment is indoors at one's home for example when the room lighting is turned off or simply not available. In this condition, downward flood lighting projects a soft pool of light around the perimeter of the rollator. This illumination enables the user to see around the perimeter of the rollator, providing sufficient illumination to enable one to walk down a hall way or through a room without turning on the room lighting in that space.

It is a principal object of this invention to provide a height adjustable frame that will move up or down to accommodate a small individual or accommodate a tall standing individual.

It is another object of the invention to provide a wheel suspension for wheeled walkers that stabilizes the walker both laterally during user stepping and longitudinally over irregular surfaces.

It is yet another object of the invention to provide a preload adjustment that may be made to facilitate customization for any user.

It is still another object of the invention to allow the frame of the rollator to be folded allowing easy storage and transportation of the rollator and to allow the seat to be retracted for walking and opened for sitting.

These and other objects, advantages, and novel features of the present invention will become apparent when considered with the teachings contained in the detailed disclosure along with the accompanying drawings.

BRIEF DESCRIPTION OF THE DRAWINGS

The present rollator invention will be described with reference to the appended Figures, in which:

FIG. 25 is a side elevational view of the finger joint fold assembly of FIG. 24;

FIG. 26 is a front and side perspective view of the finger joint fold assembly of FIG. 25;

FIG. 27 is a side elevational view of the finger joint fold assembly of FIG. 25 showing the finger joint fold assembly in folded condition when the rollator frame is folded for storage;

FIG. 28 is a front elevational view of the finger joint fold assembly of FIG. 27

FIG. 29 is a perspective view of the finger joint fold assembly of FIG. 27;

FIG. 48 is an enlarged perspective view of the wheel, rim, spokes, rotor and tire;

FIG. 49 is a smaller reversed side elevational view of the wheel of FIG. 48;

FIG. 50 is a front elevational view of the wheel of FIG. 49;

FIG. 51 is a cross-sectional view of the wheel of FIG. 50 taken along line 49'-49' of FIG. 49.

DESCRIPTION OF THE INVENTION

The present invention is directed towards a height adjustable rollator with a first preferred embodiment of the invention shown in FIGS. 1 through 14, a second most preferred embodiment is shown in FIGS. 15 through 33 and a third preferred embodiment is shown in FIGS. 34 through 47. The wheel construction and brake rotors which can be used for all three embodiments are shown in FIGS. 48 through 52. The drive mechanism for transferring force from the brake hand levers to the rear wheels is shown in FIGS. 30 through 33.

In general, all embodiments of the invention are specifically designed to facilitate erect walking posture of the user while also enabling responsive rotational movement of the user within a small space. It is also designed to enable a wide range of locomotor speeds and rehabilitative applications by enabling adjustment of the user's center of body weight relative to the rollator base of support. Finally, this invention can be configured to allow seated mobility through leg pushing or pulling movements.

Figure 1:
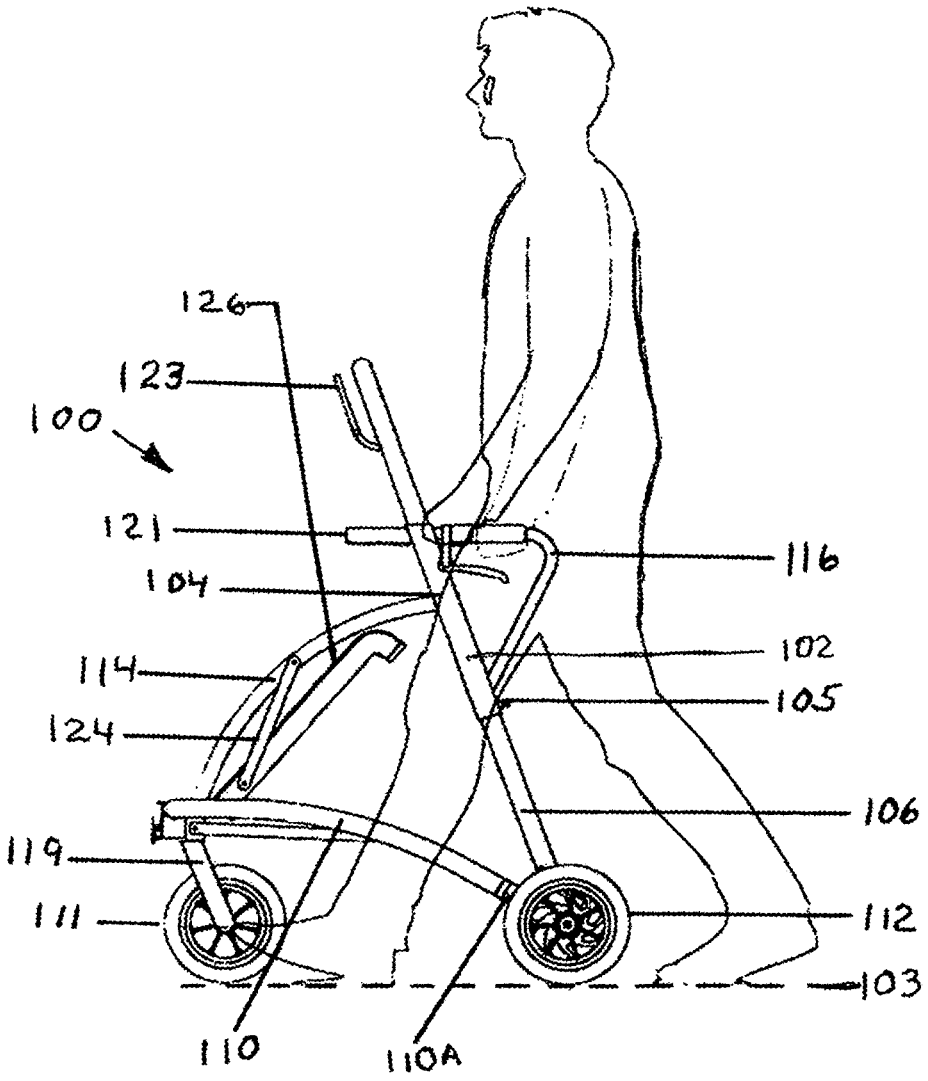
FIG. 1 is a side elevational view of the rollator with the seat retracted showing the user in full gait.

FIG. 1 shows an upright wheeled walker (rollator) 100 with a frame 102 supported above a ground surface 103 on two rear wheels 112 and two front wheels 111. These wheels have a standard hub with spokes which engage the wheel rim or alternatively the wheel design for the rear wheels can be the embodiment shown in FIGS. 48 through 51. The rollator can have one or more (e.g., preferably two) front wheels 111, each of which can be mounted on a swivel yoke structure 119 with the rear wheels mounted on axles which do not swivel. The tires of the device can be made of a material selected from the group consisting of hard rubber, pneumatic tires, and cushion supported wheel treads. As previously noted, the rear brake wheels are shown in more detail in FIGS. 48 through 51. The handle bar/backrest assembly slides up and down on the main upright frame section to adjust to the users height.

Figure 3:
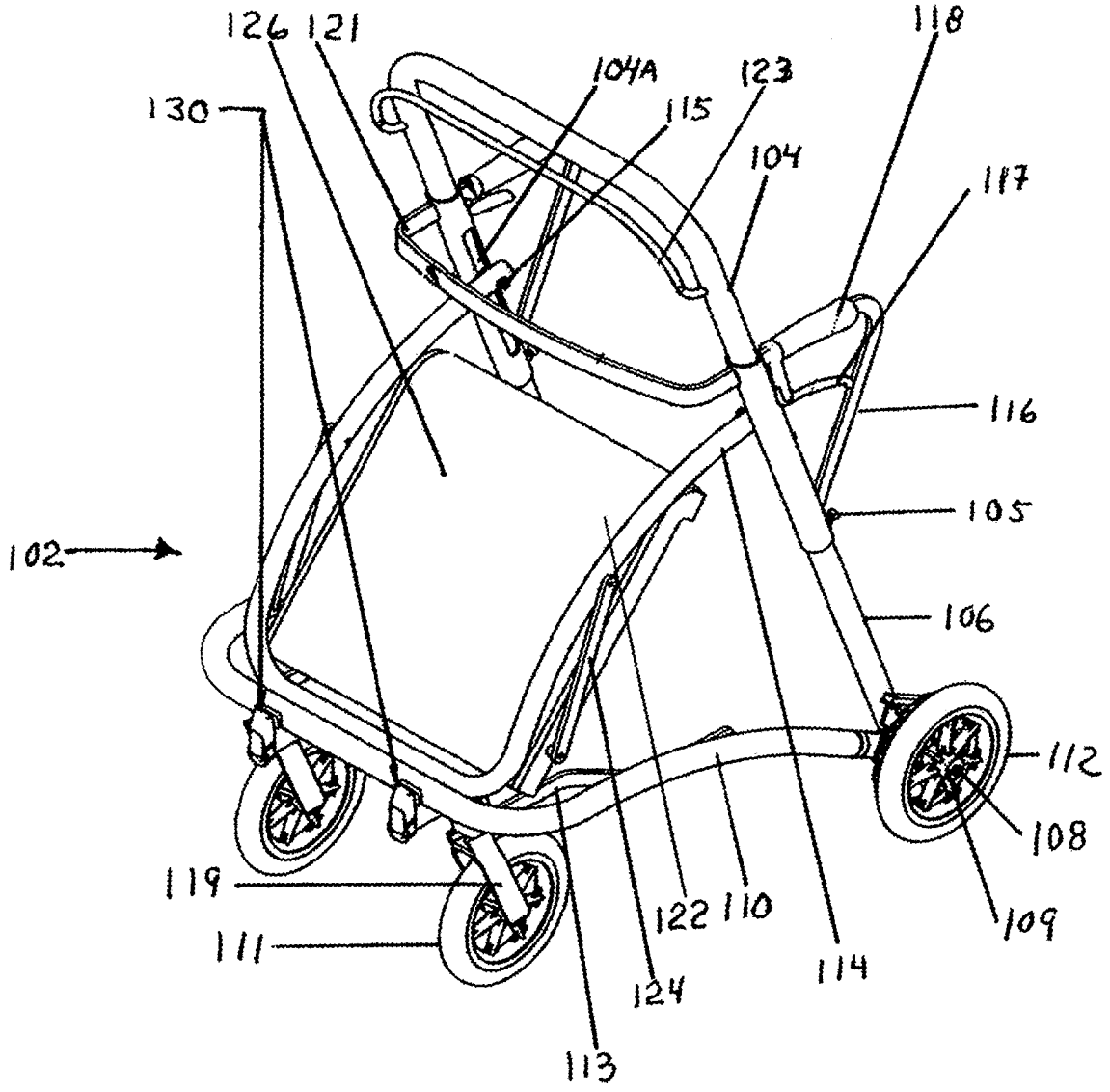
FIG. 3 is a perspective view of the inventive rollator with the seat in the retracted position.
Figure 4:
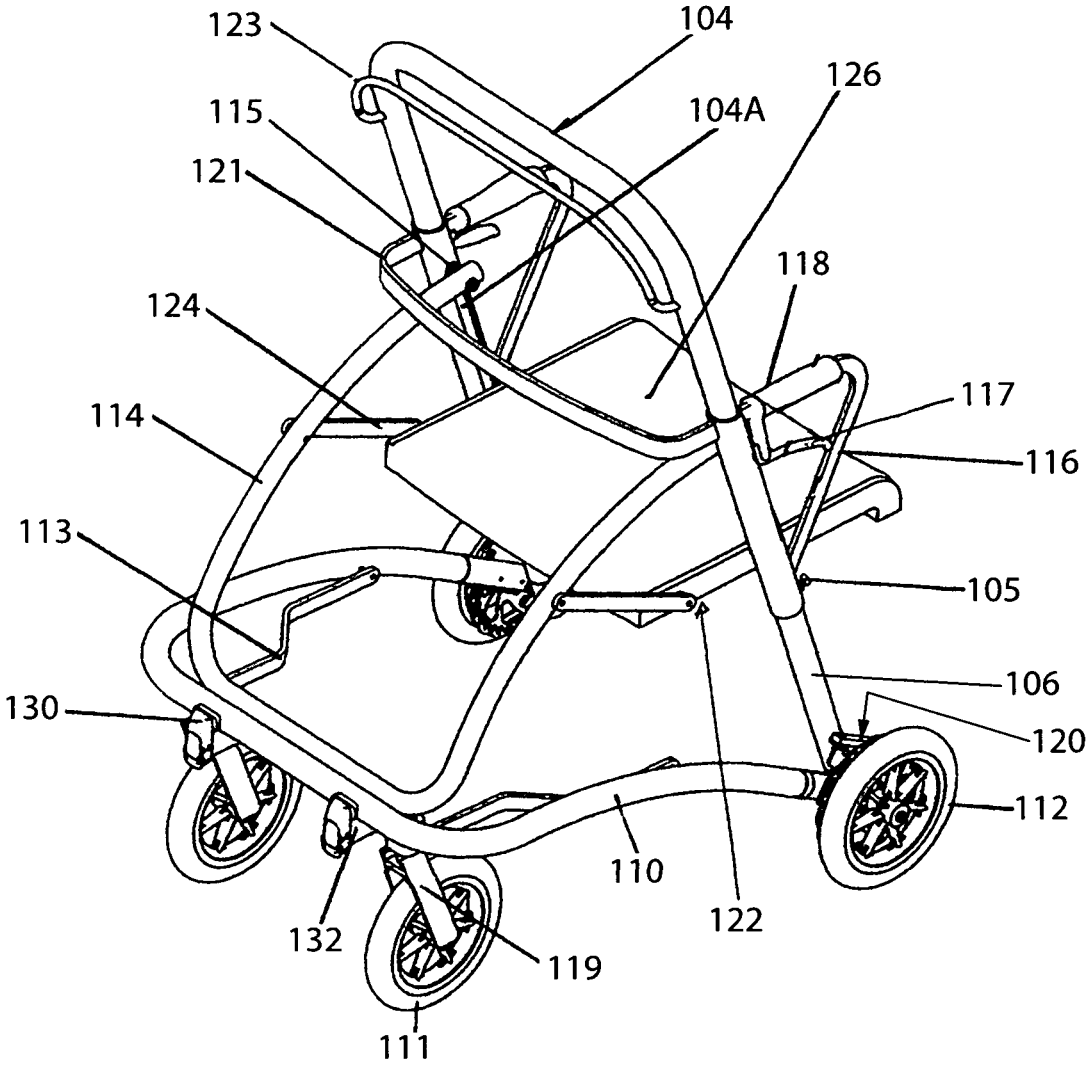
FIG. 4 is a perspective view of the inventive rollator with the seat in an open position for seating.
Figure 8:
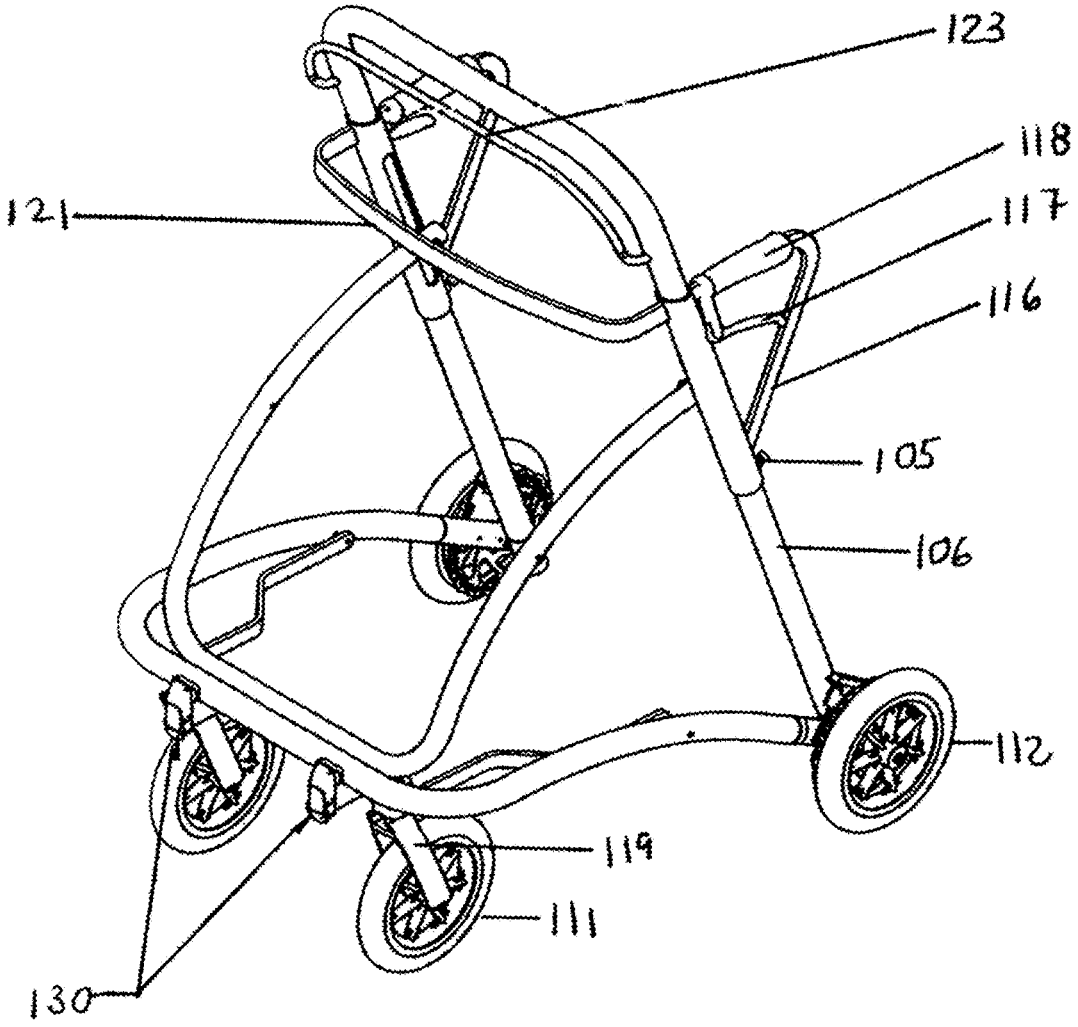
FIG. 8 is a front and side perspective view of the rollator as shown in FIG. 6.
Figure 9:
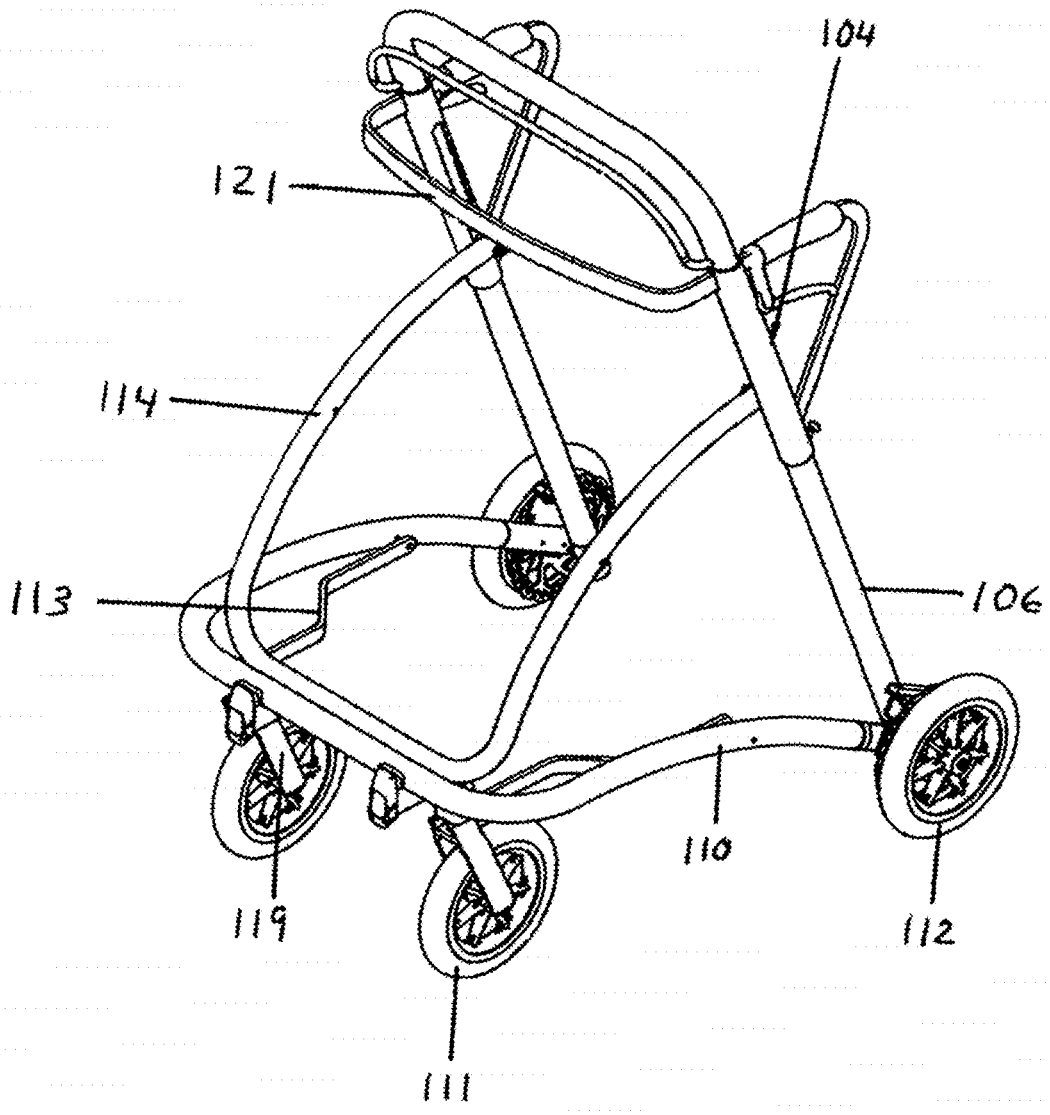
FIG. 9 is a side perspective view of the rollator as shown in FIG. 7.

The front wheel yokes 119 as shown in FIGS. 3, 4, 8 though 10 and 20 can be made of round metal tubing, square metal tubing, or structural plastic, with aligned mounting holes on the distal end of each folk of the yoke to receive a front wheel axle.

Figure 2:
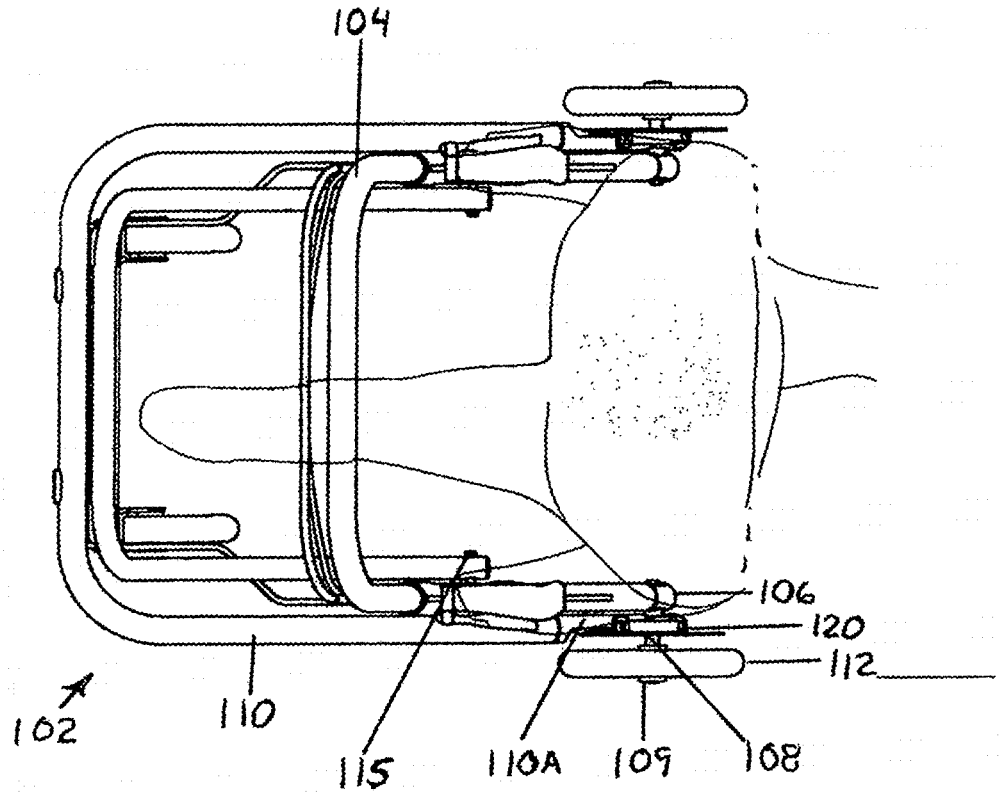
FIG. 2 is a an enlarged top plan view of the inventive rollator without the seat and the user shown in phantom.
Figure 5:
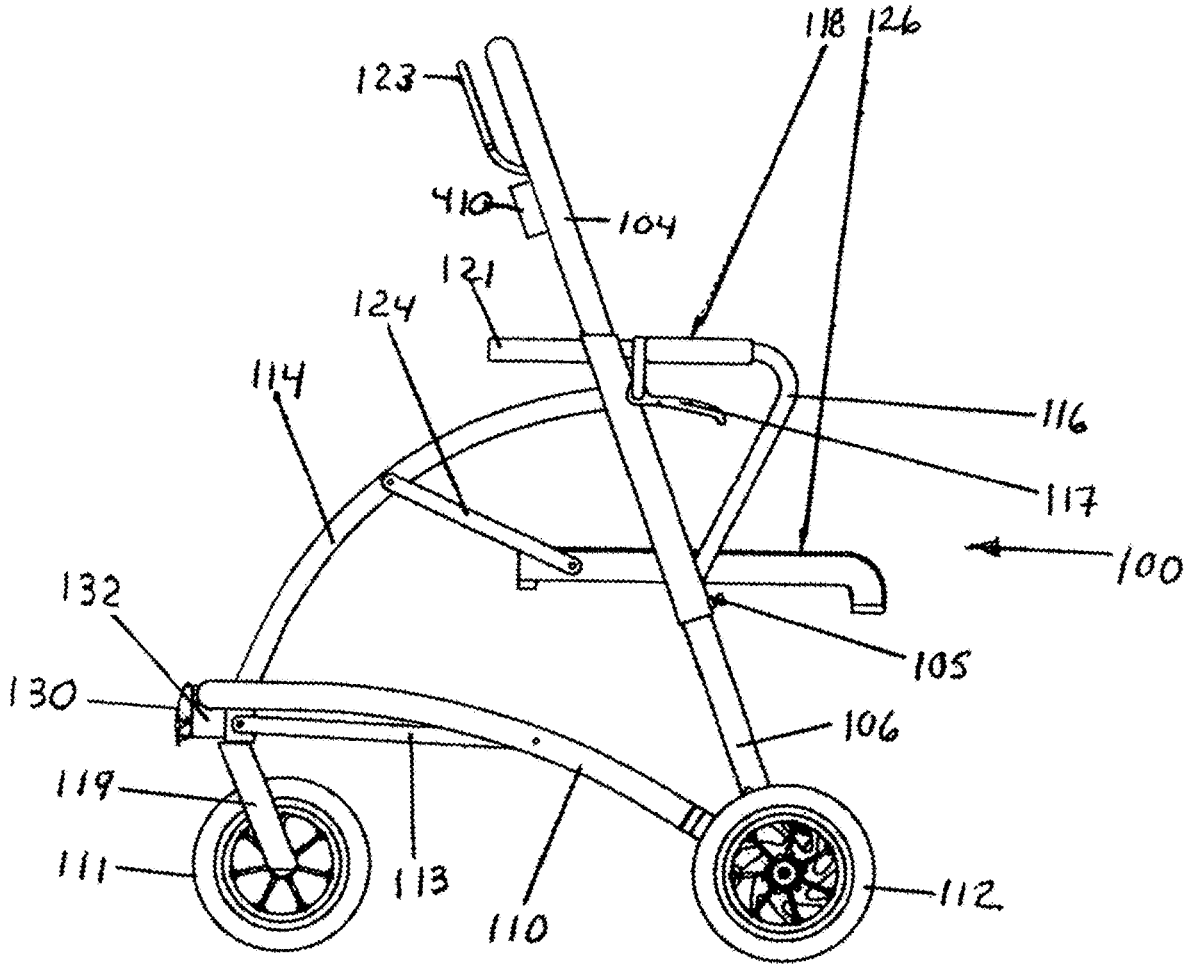
FIG. 5 is an enlarged side view of the inventive rollator in FIG. 1 with the seat in an open position for seating.
Figure 6:
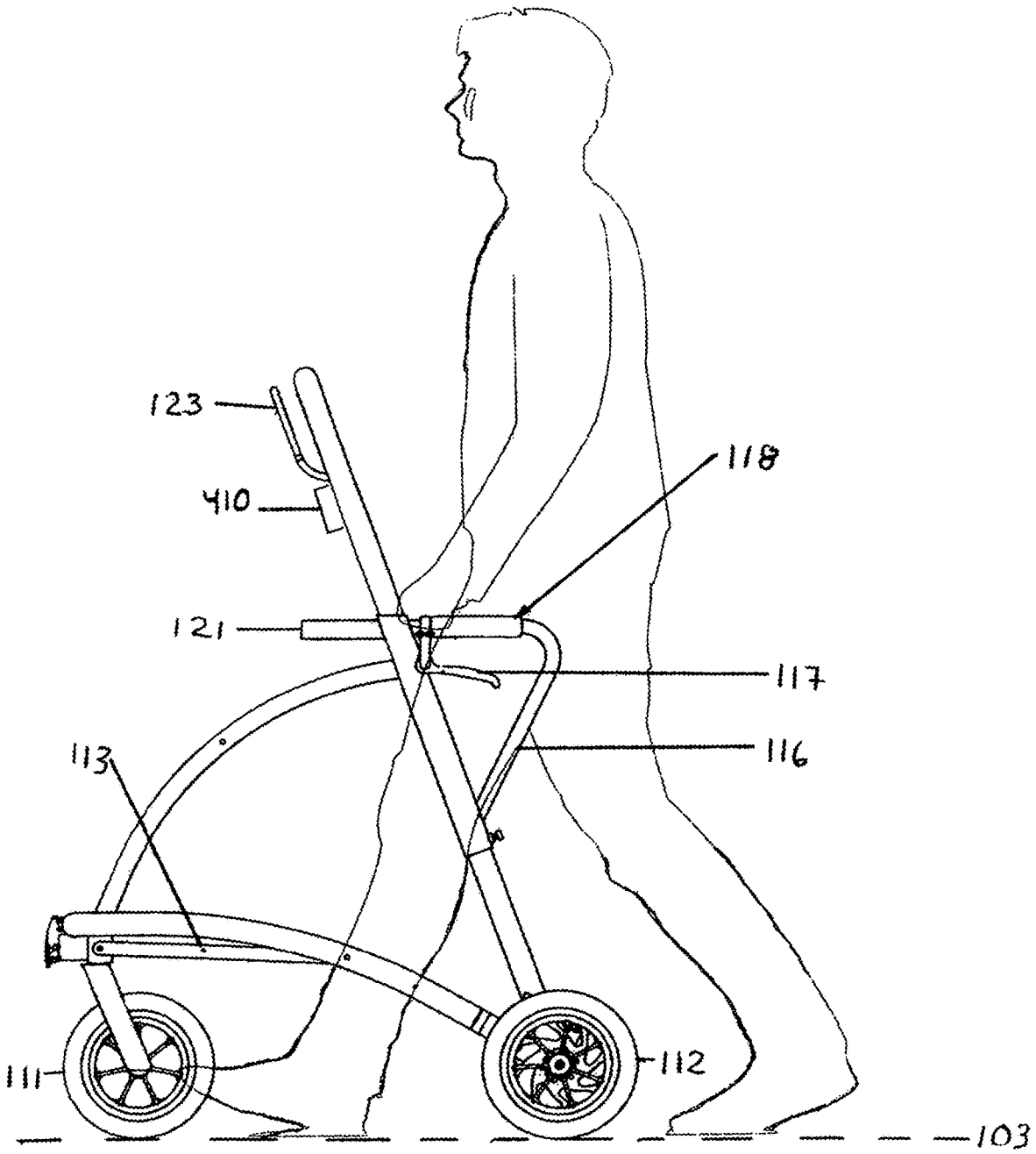
FIG. 6 is a side view of the rollator with the seat removed and the handgrip frame adjusted to the highest position.
Figure 10:
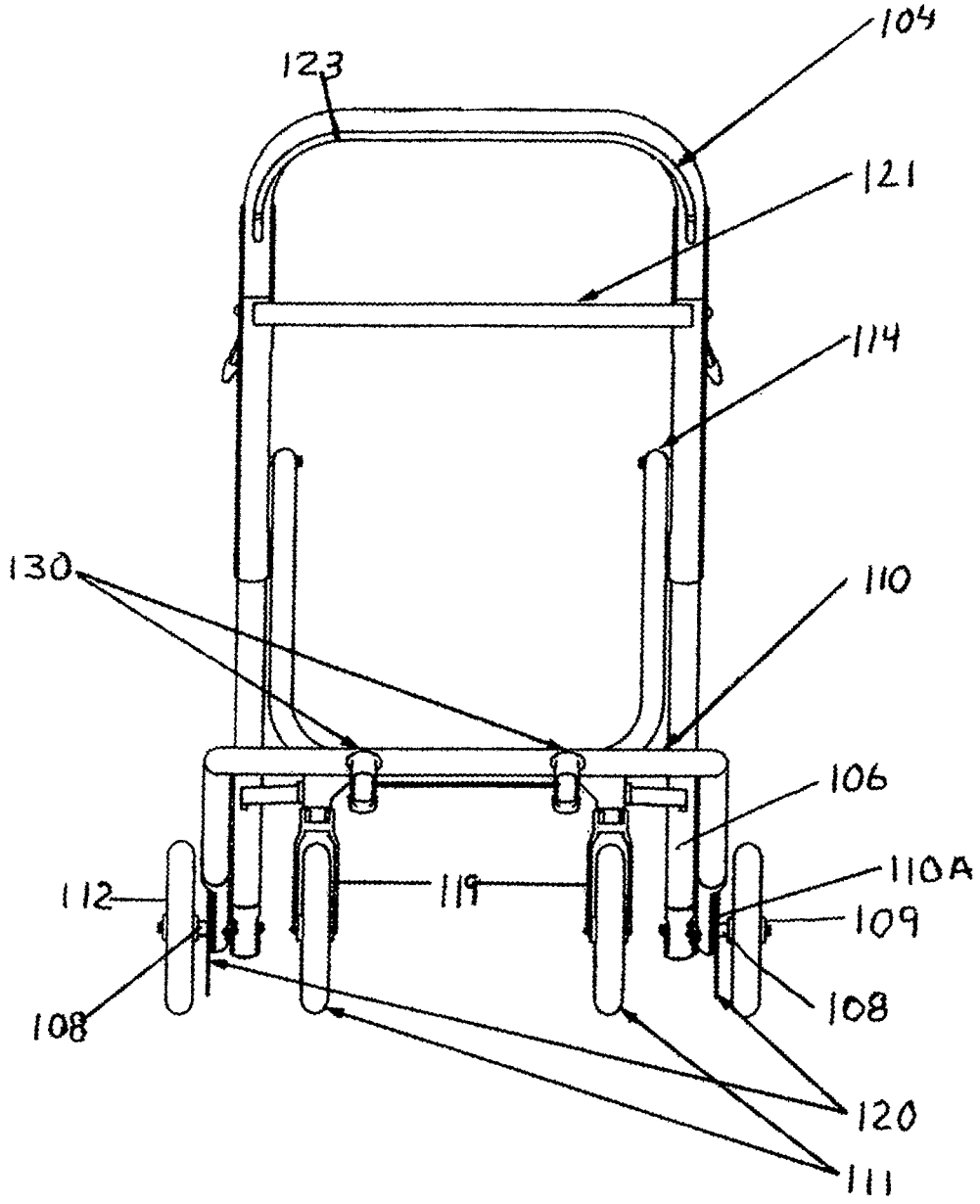
FIG. 10 is a front elevational view of the rollator shown in FIG. 7.
Figure 11:
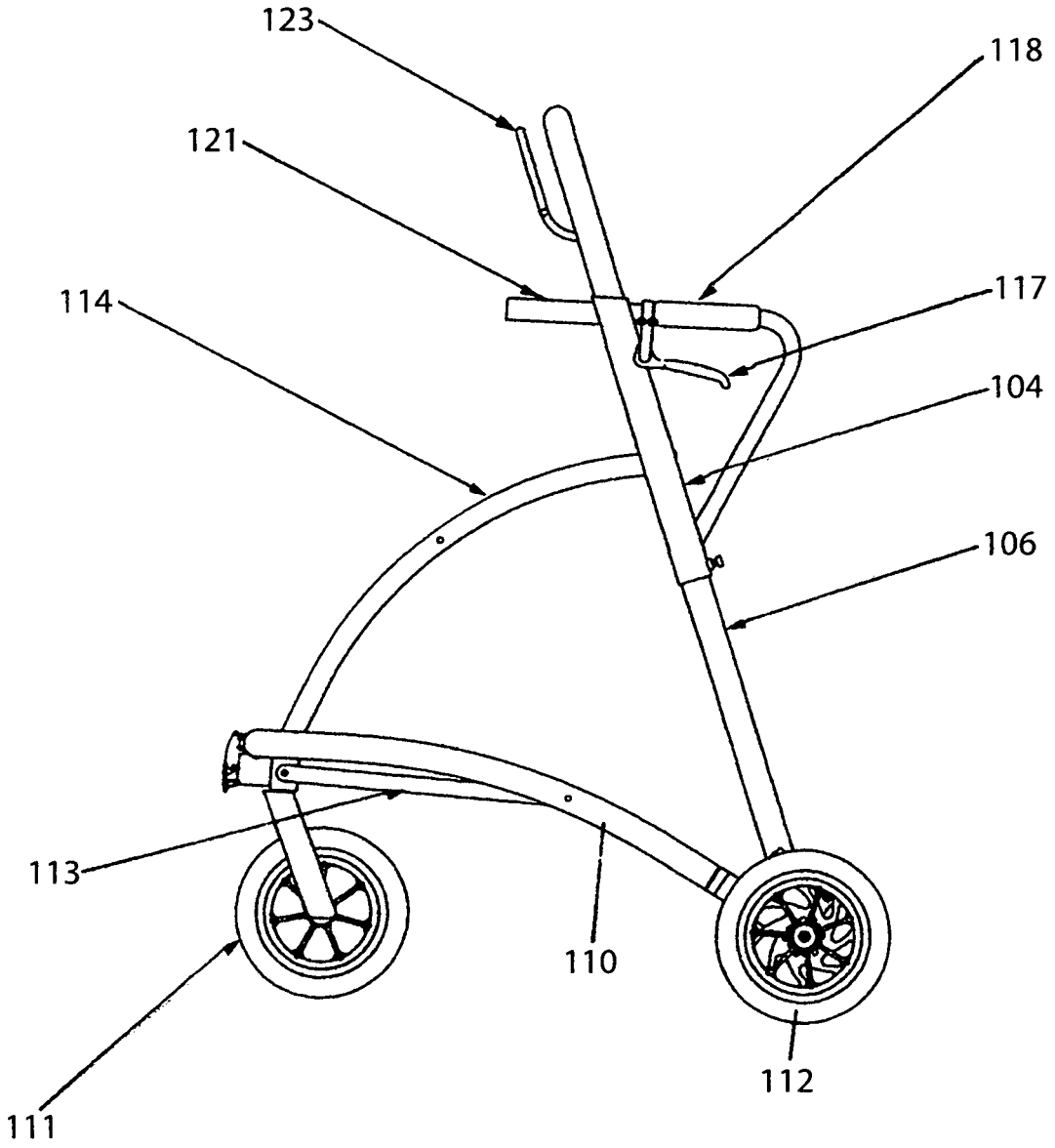
FIG. 11 is a side elevational view of the rollator as shown in FIG. 10.
Figure 12:
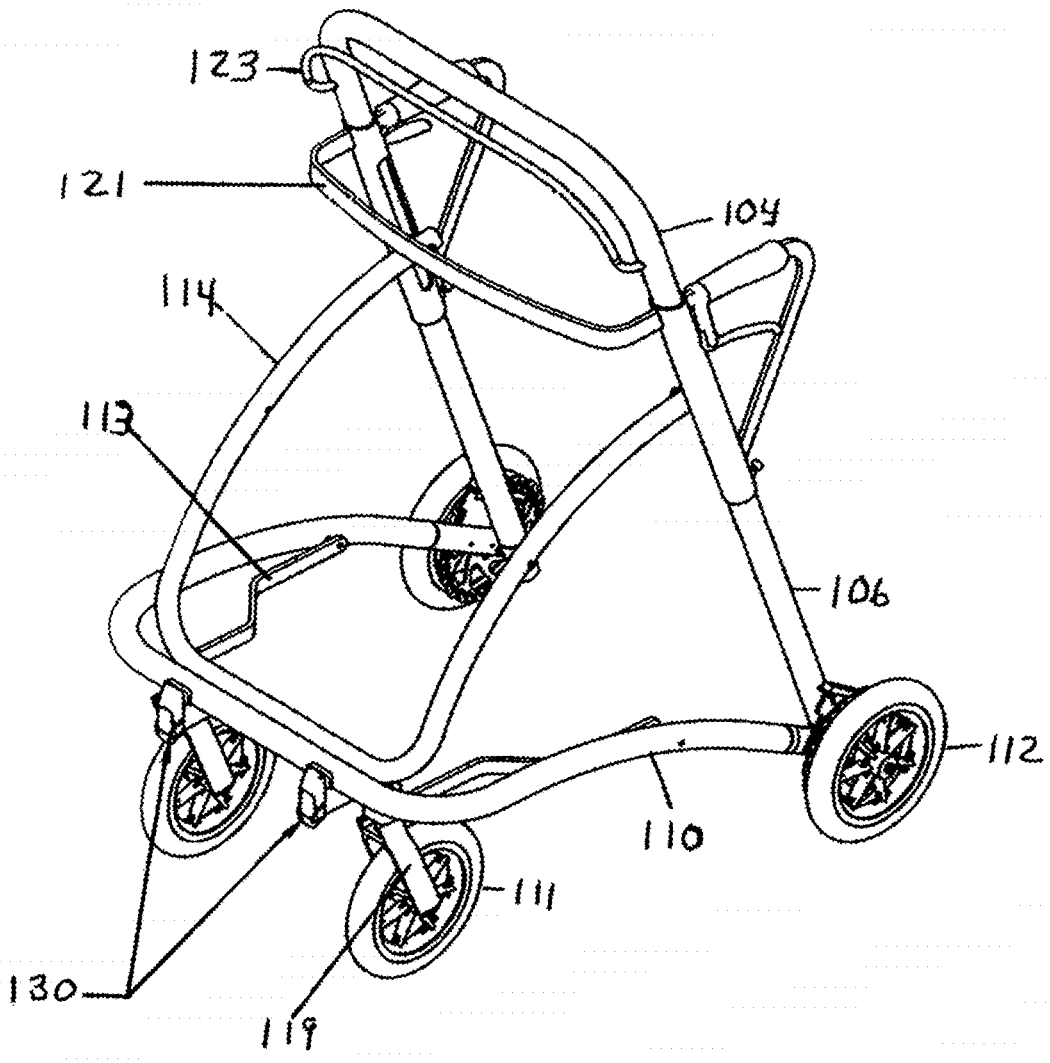
FIG. 12 is a perspective view of the rollator shown in FIG. 10.
Figure 13:
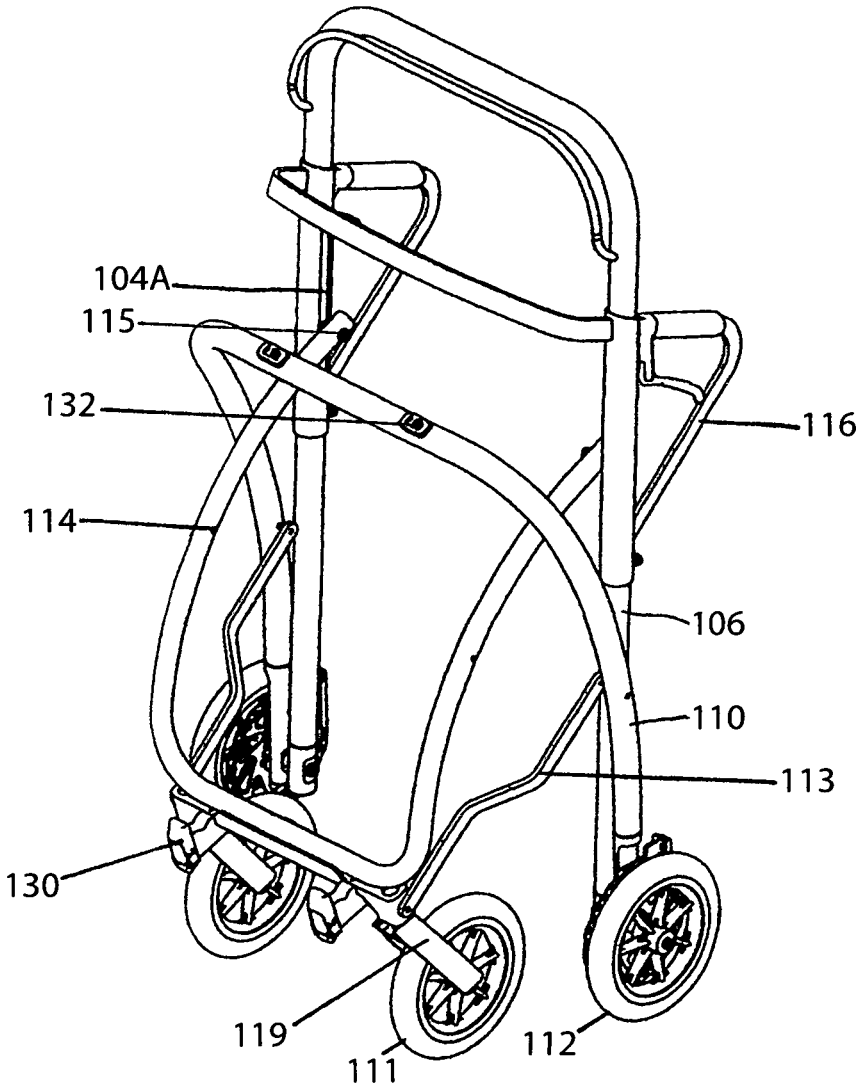
FIG. 13 is a perspective view of the rollator as shown in FIG. 12 in a folded position.

One preferred embodiment of the rollator 100 comprises a multi-sectional coupled frame 102 which is constructed of a U-shaped upright main frame section 104 which is mounted on axles 108 as shown in FIG. 2. A U-shaped lower base frame section 110 is also mounted to axles 108 and is positioned adjacent the ends of upright main frame section 104. The lower base frame section 110 has curved legs and the upright section 104 has legs which angle away so that the user is centralized and standing upright in the frame 102 which provides balance and stability to the user. The legs 106 of the U-shaped main upright section 104 are of fixed length and the handle bar/back rest assembly moves up and down the main upright frame section 104 to adjust for height relative to the ground plane. A removable pin 105 shown in FIGS. 1 and 3-5 is inserted into an aligned series of holes of upright main frame section 104 and leg 106 to hold the handle bar and seat assembly in place. Each leg 106 holds or supports an axle 108 at its distal end. The axles 108 also hold the curved or bowed U-shaped lower base frame section 110 by its distal leg end section **110*a* as seen in FIG. 10. Thus base frame section 110 is mounted adjacent to leg 106 of the upright section 104 on axle 108. Rear wheels 112 are mounted on axle 108 via bearing assembly 109 mounted on the outside distal end of the U-shaped lower base frame section 110. The bearing assembly 109 is more clearly shown in FIG. 10 or in FIG. 37. A curved U-shaped intermediate support and pivot frame section 114 is mounted to the U-shaped upright support 104 by pin means 115 which rides in groove 104*a* as shown in FIGS. 3, 4 and 13. The front of intermediate support and pivot frame section 114 is connected by pivotable linkage member 113 to the U-shaped lower base section frame 110 as shown by FIG. 5. The front swivel wheels 111 are mounted in yokes 119 secured to the lower pivoting base section frame 110. Thus, the user is positioned upright within the composite frame 102 and the four wheel base in a stable orientation. A handgrip frame member 116 as shown by FIGS. 4 and 6 is mounted to each side of the U-shaped upright section 104 with the distal end of each handgrip frame member 116 being provided with a brake lever 117 and a handgrip 118 adjacent to the brake lever 117. Each brake lever 117 is operatively connected to right and left calipers which engages rotors 120 which are synchronized to engage rear wheels 112 as shown in FIGS. 2 and 10. An illuminator or light 410 provides illumination for the rollator as seen in FIG. 6** as is later discussed.

The invention couples both brakes to a single lever with balanced brake force applied to the wheels. Each of the two rear wheel are braked evenly with single handed squeeze of the brake handle. The brake handle may be mounted to either left or right side or on both sides depending on preference of user. This provides a meaningful functional opportunity for stroke patients who may have issues with the strength or coordination of one side vs the other hand.

Only one single brake handle lever 117 is used to apply even balanced braking force to the two rear wheels which provides the following benefits to the user.

In many cases the aged cannot apply the same hand strength on left and right side. In some users one hand may be significantly compromised. Therein, the user must rely on one hand for all tasks that require grip strength.

The rollator has a "therapist activated" tensioner to modulate controlled brake resistance on the rear wheels to manage/limit the user's speed or effort. Continuous controlled resistance may be utilized by the user through the brake system to reduce velocity when moving downhill over some distance. Controlled resistance may also be applied to the rear wheels to satisfy a different objective. Continuous controlled resistance may be applied by a physical therapists and utilized to make the user apply additional muscular force to push (walk with) the upright mobility device. This would be analogous to an exercise bicycle or treadmill where the resistance is utilized to improve muscle tone. With a precision brake the resistance can be applied (increased/decreased) to precisely manage the level of resistance the user must work against.

Figure 7:
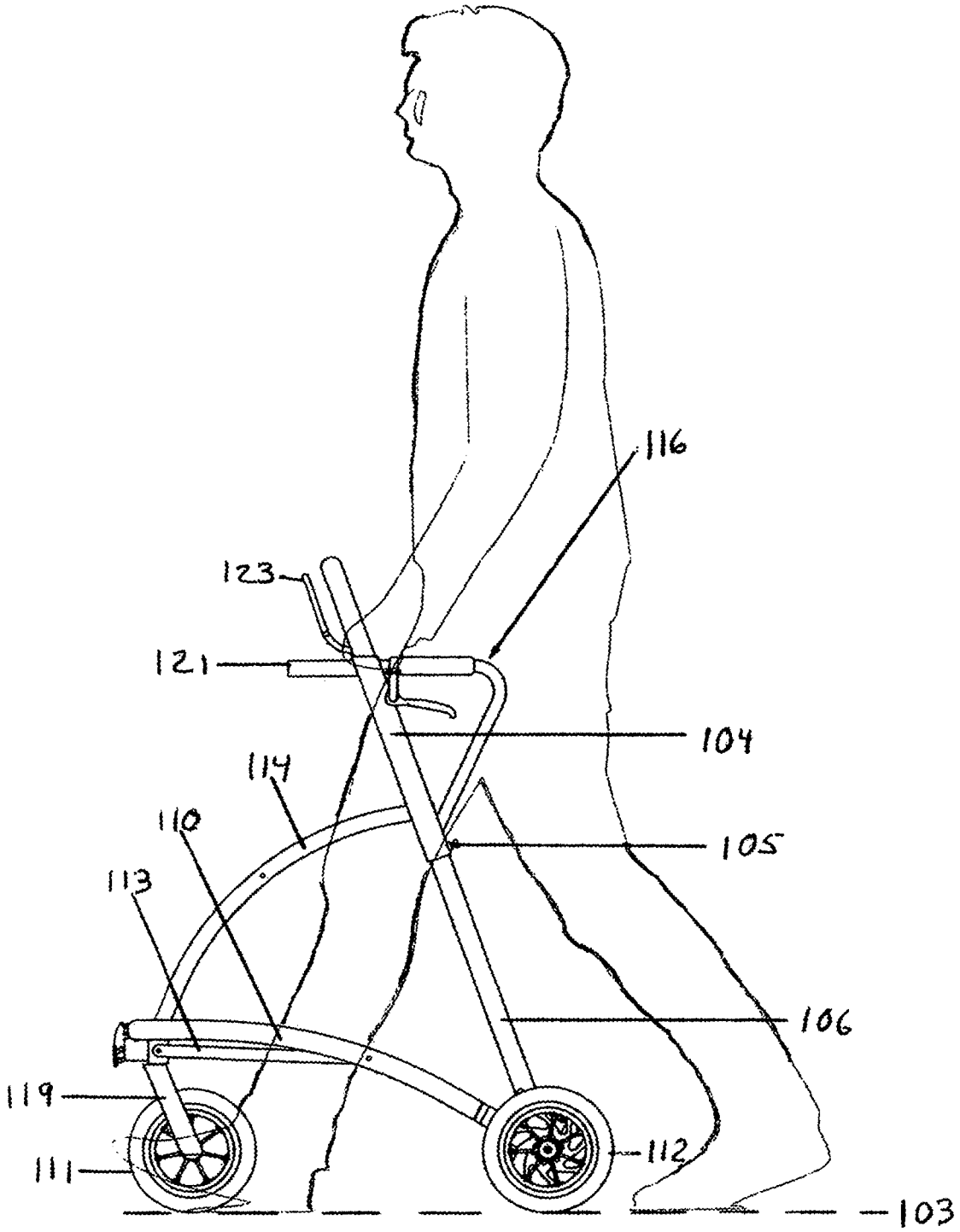
FIG. 7 is a side view of the rollator of FIG. 6 with the handgrip frame adjusted to the lowest position.

The handgrip frame members 116 can be adjusted as seen in FIGS. 6 and 7 to high or ow positions. An accessory rail/back rest support 121 is mounted on the forward surface of upright frame section 104 opposite handgrip frame member 116. A push bar brake lever 123 is mounted on the upright section 104 above the accessory rail rest support 121.

The rollator can be provided with a seat assembly 122 as shown in FIGS. 3-5 which discloses a seat 126 mounted to pivoting linkage members 124 which are also pivotally mounted to each side of the curved U-shaped intermediate support section 114. This allows the seat 126 to be retracted as seen in FIG. 3 or opened for seating as shown in FIG. 4. It should be noted that the ends of intermediate frame section 114 are adjustably mounted in groove 104A cut in the inner side of U-shaped frame 104 as seen in FIGS. 3 and 4.

Figure 14:
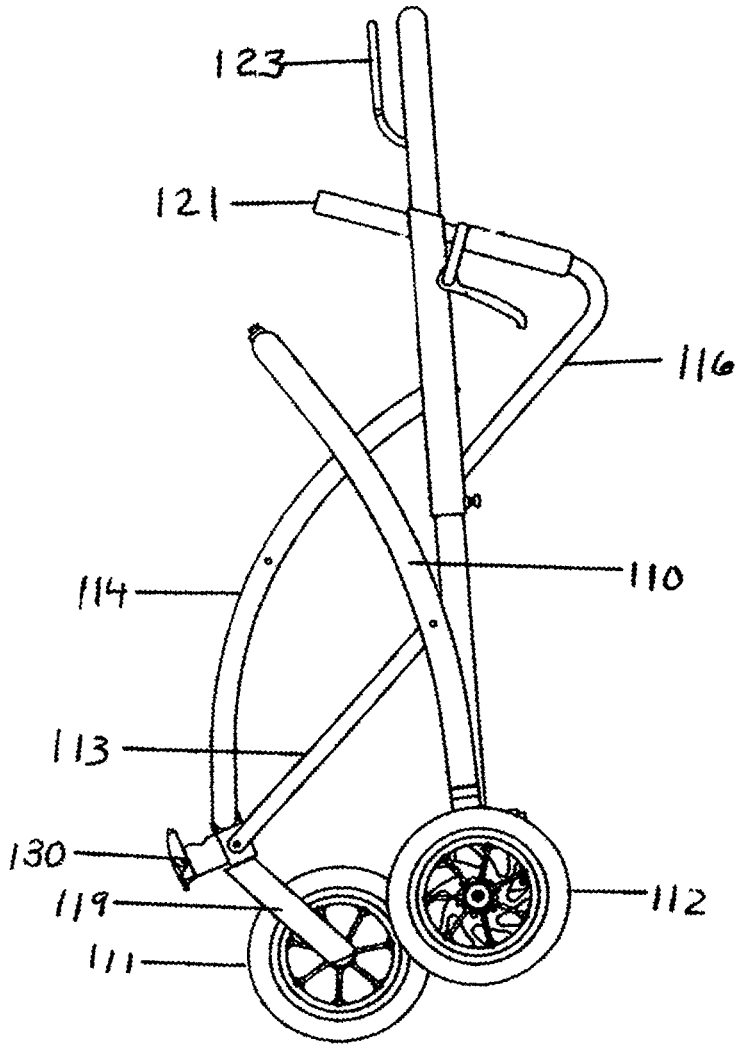
FIG. 14 is a side view of the folded rollator shown in FIG. 13.

Locking latches 130 are each secured on the front portion of the curved U-shaped support and pivot frame 114 and receive latch support member 132 which are mounted on the front section lower base frame section 110 to hold the seat 126 and frame in open position (See FIGS. 4 and 5) and are released or disengaged to allow the frame 102 to fold into a compact folded position as shown in FIGS. 13 and 14.

A second most preferred embodiment of the rollator 150 is shown by FIGS. 15 through 23 comprises a multi-sectional coupled frame 152 which is constructed of a U-shaped main upright frame section 154 which is connected to a U-shaped lower base frame section 160 at an angle away from the vertical and an intermediate frame section 164 which is mounted to the lower base frame section 160 and the upright main frame section 154 so that the user is centralized and standing upright within the frame 152 which provides balance and stability to the user.

Figure 15:
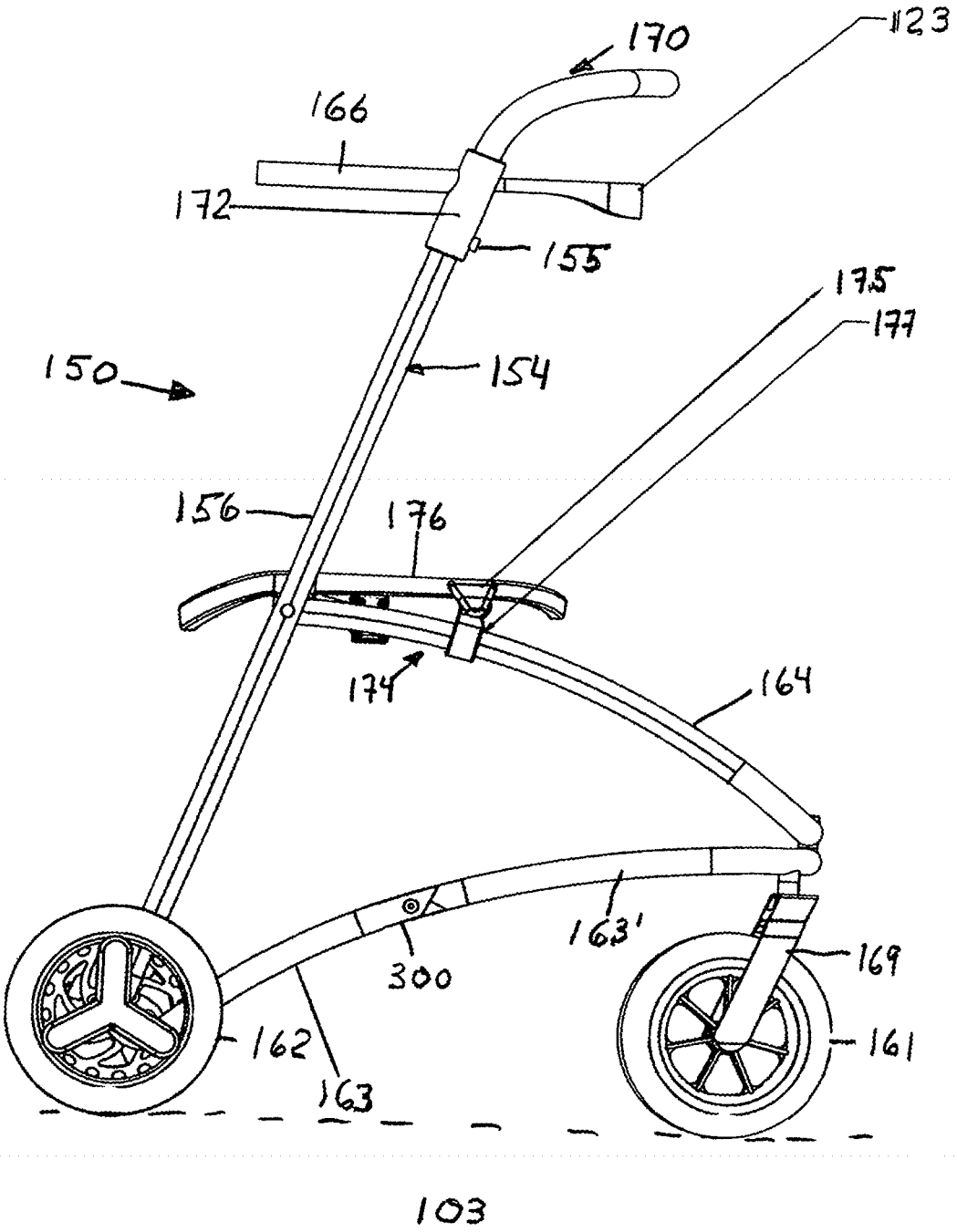
FIG. 15 is an enlarged side elevational view of the most preferred embodiment of the rollator with the seat in place showing the showing the finger joint fold assembly mounted in the lower base frame section.
Figure 16:
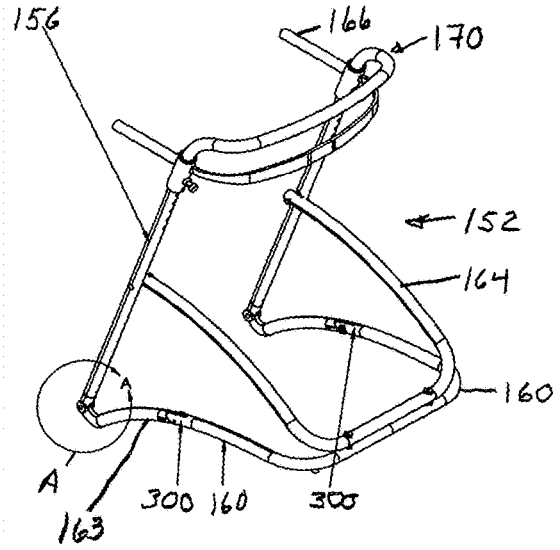
FIG. 16 is a front view of the frame of the rollator as shown in FIG. 15.
Figure 17:
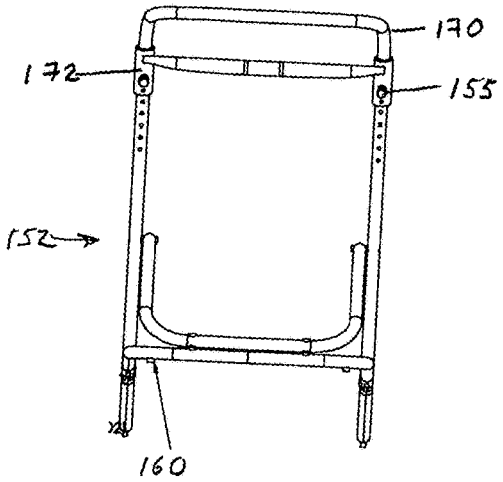
FIG. 17 is a front elevational view of the frame of the rollator shown in FIG. 16.
Figure 18:
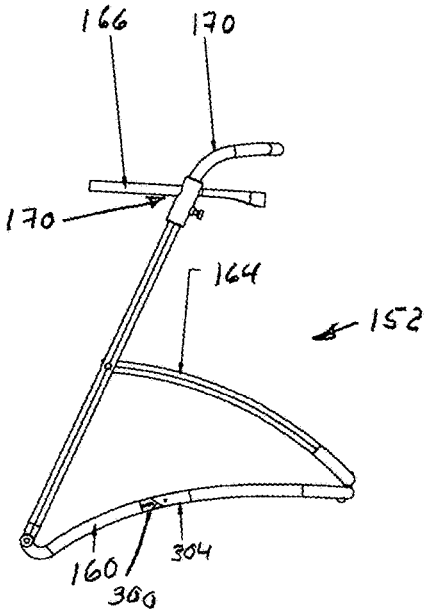
FIG. 18 is a side elevational view of the rollator frame shown in FIG. 16.

FIG. 15 shows an upright wheeled walker (rollator) 150 with a frame 152 as seen in FIGS. 16, 17, and 18 supported on a surface 103 by two rear wheels 162 and two front wheels 161. The rollator can have one or more (e.g., two) front wheels, each of which can be mounted on a swivel yoke structure 169. The rear wheels do not swivel. The front wheel yokes 169 can be made of round metal tubing, square metal tubing, or structural plastic, with mounting holes on the distal end of each yoke to receive a front wheel axle. The tires of the device can be made of a material selected from a group of materials such as hard rubber, pneumatic tires, and cushion supported wheel treads. Preferably, the tires are a low profile rubber tire. The wheels can be a standard spoke, custom spoke or solid from shaft to rim or can be configured as shown in FIGS. 48 through 51.

During use, a user stands between the frame sections and grasps each of the upper handle grips 166 with one hand.

Figure 16A:
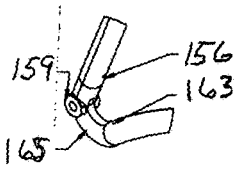
FIG. 16A is an enlarged perspective view of the pivot assembly shown in the encircled area A of the frame of FIG. 16.
Figure 17A:
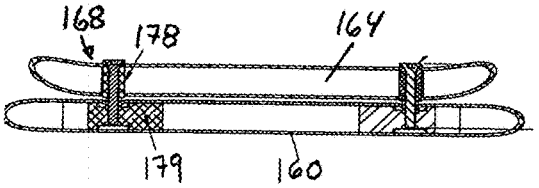
FIG. 17A is an enlarged cross section taken of the lower caster mount for the front wheel yokes and the front of the frame section and front of the intermediate frame section.
Figure 19:
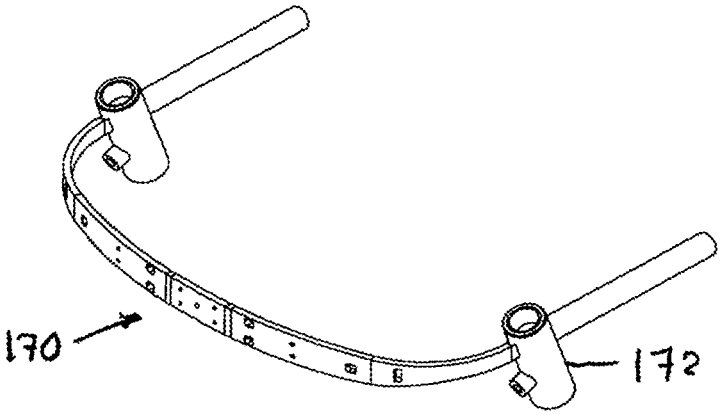
FIG. 19 is a perspective isolated view of the back rest frame of the rollator shown in FIG. 15.
Figure 20:
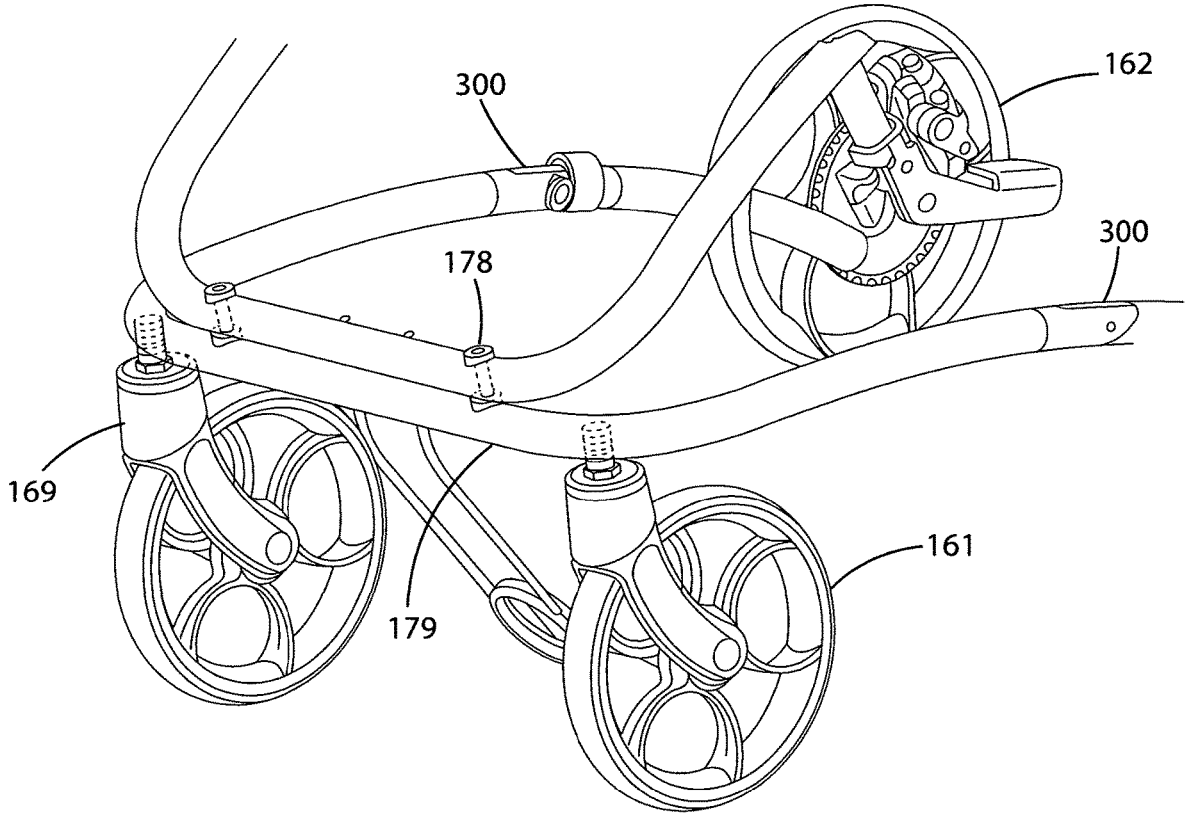
FIG. 20 is an enlarged perspective view showing the front of the intermediate frame section and the lower strut hinge and caster of the lower base frame section in phantom.

The legs 156 of the U-shaped main upright frame section 154 allow the handle bar/back rest assembly 170 to be adjusted for height and the preferred height is set by means of a removable spring pin 155 which is inserted into sleeve 172 of the handle bar/back seat assembly 170 into aligned holes of upright main frame section leg 156 as best seen in FIGS. 16, 17 and 19. Each main frame leg 156 holds or supports an axle or wheel shaft in an axle mount 159 as shown in FIG. 16A. The axle mount 159 also holds a curved connector member 165 which is mounted to the end 163 of U-shaped lower base section frame 160 as seen in FIGS. 16, 16A. Rear wheels 162 are mounted on axles 158 via a bearing race 159. A curved U-shaped intermediate support and pivot frame section 164 is mounted to the U-shaped lower base frame section 160 by hinge assembly 168. The hinge assembly 168 is formed by a rotating plug 179 rotatably mounted in the lower base strut section 160 as seen in FIG. 17A and having a threaded fastener 178 as also seen in FIG. 17A which is mounted in intermediate strut section 164. The front swivel wheels 161 are mounted in yokes 169 secured to the lower base frame section 160. Each of the legs 163 of the lower base frame section 160 are provided with a finger joint fold assembly 300 allowing the lower base frame section 160 to be folded.

Figure 23:
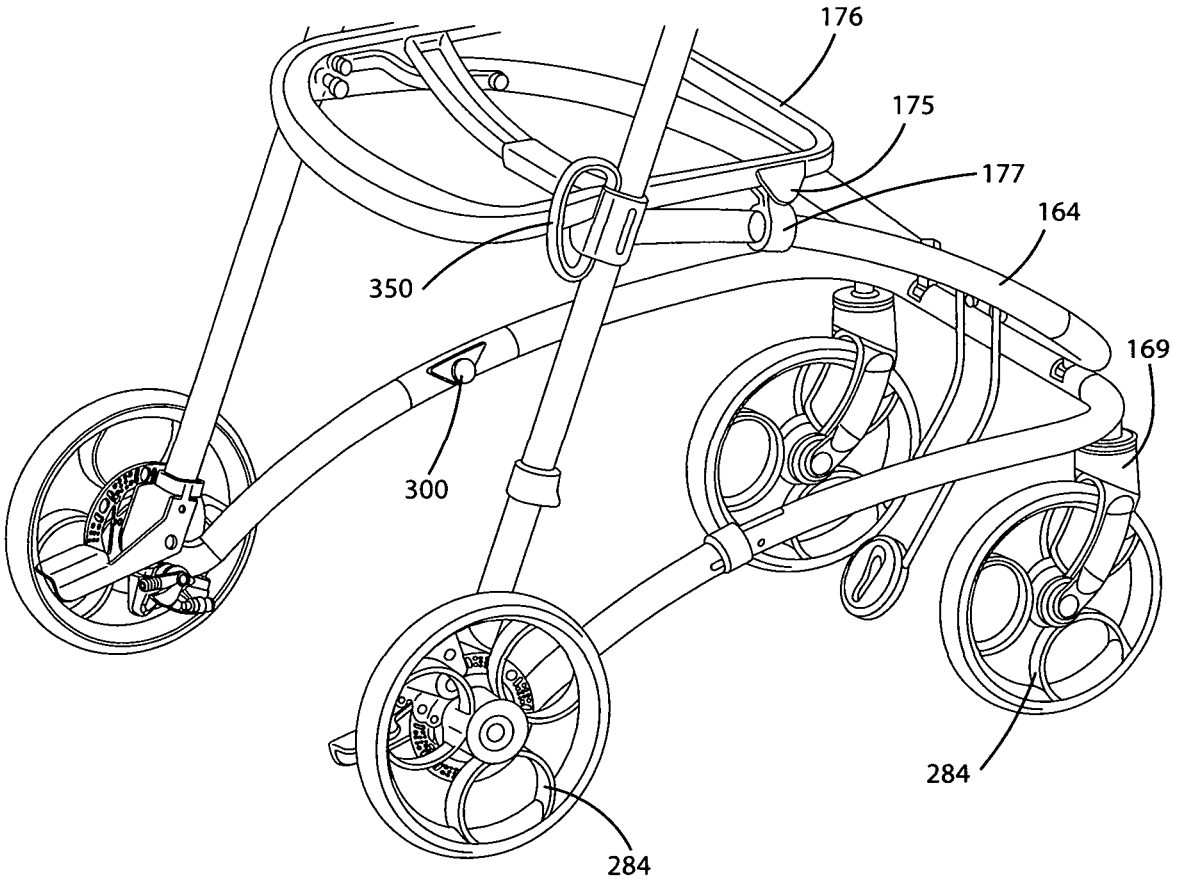
FIG. 23 is an enlarged perspective view of the seat frame, base frame section and intermediate section of the rollator.
Figure 24:
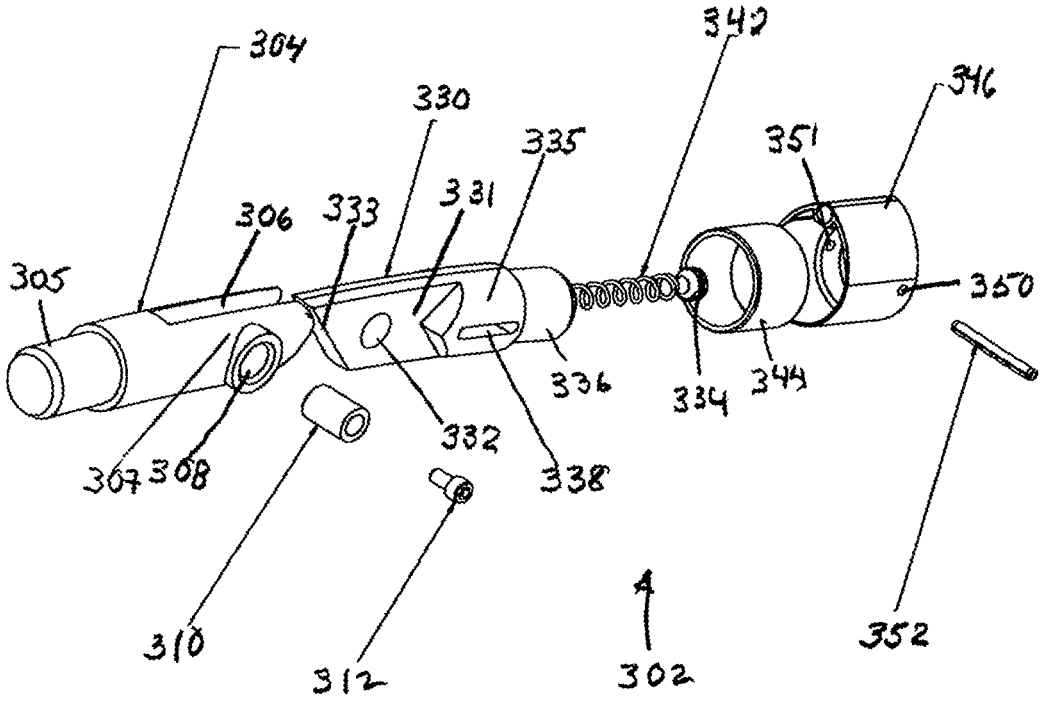
FIG. 24 is an enlarged exploded perspective view of the finger joint fold assembly of the invention shown in the lower base frame section of the rollator shown in FIGS. 15, 16 and 18.
Figure 30:
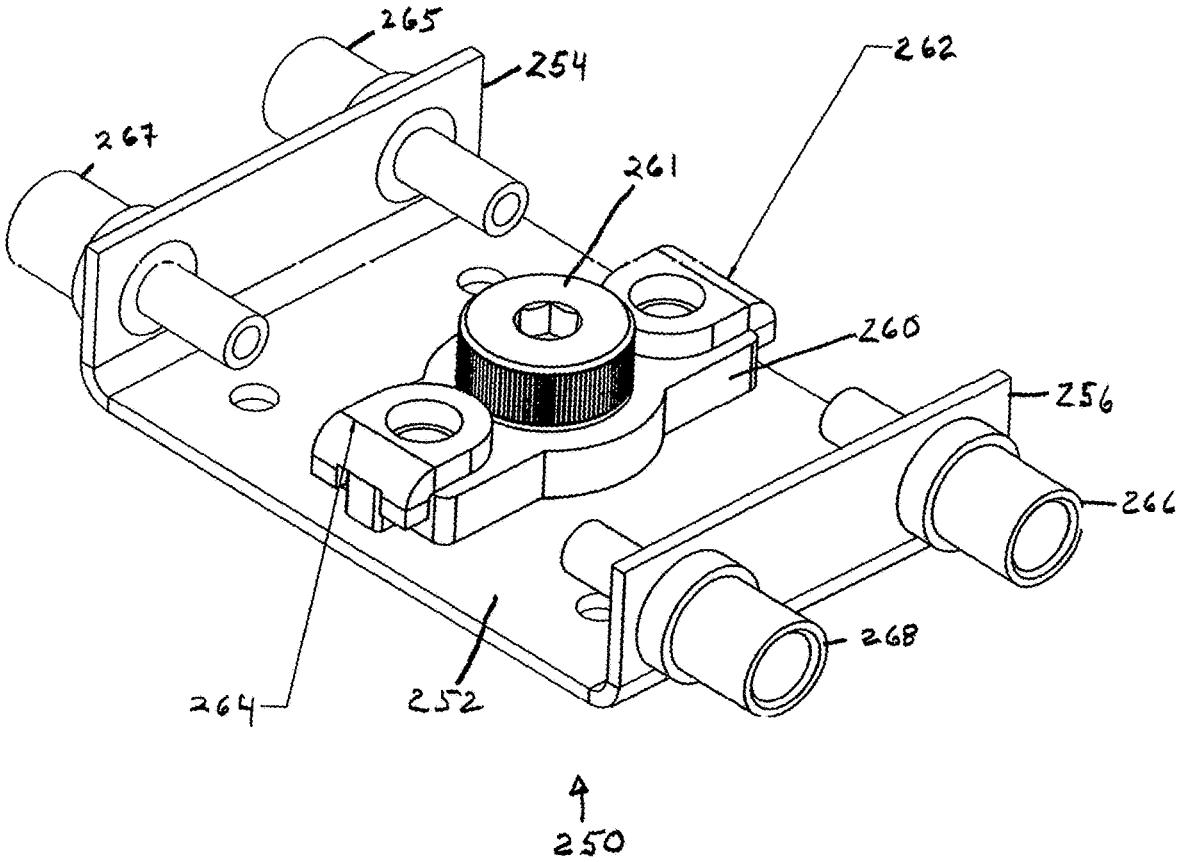
FIG. 30 is a perspective view of the force transfer mechanism which transfers force from activation of the brake lever via cables to a brake rotor mounted on the rear wheels of the rollator.
Figure 31:
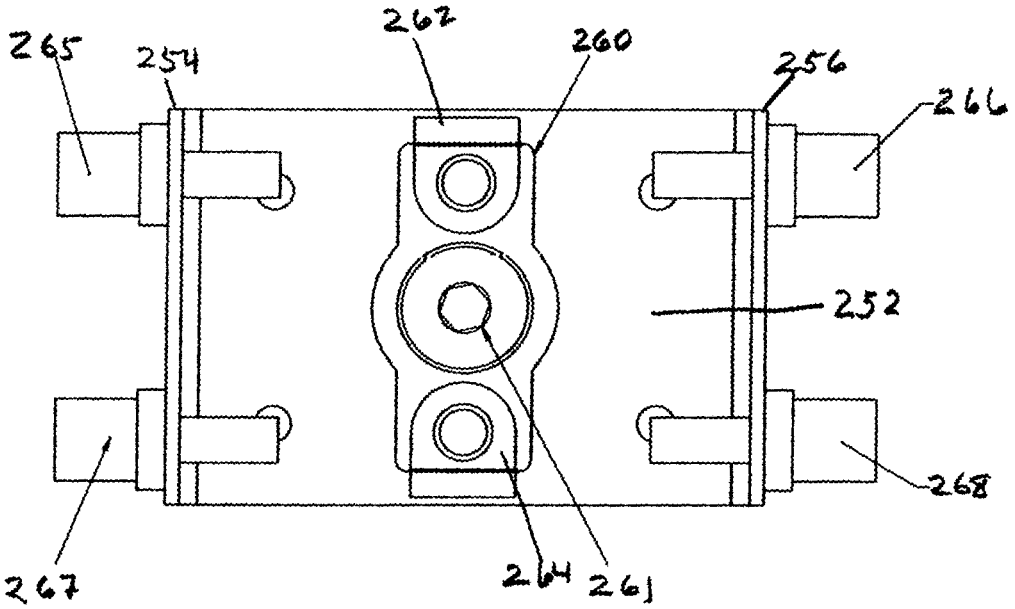
FIG. 31 is a smaller top plan view of the force transfer mechanism of FIG. 30.
Figure 32:
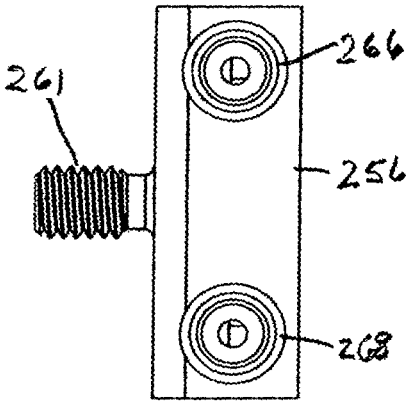
FIG. 32 is an end view of the right end of the force transfer mechanism of FIG. 31.
Figure 33:
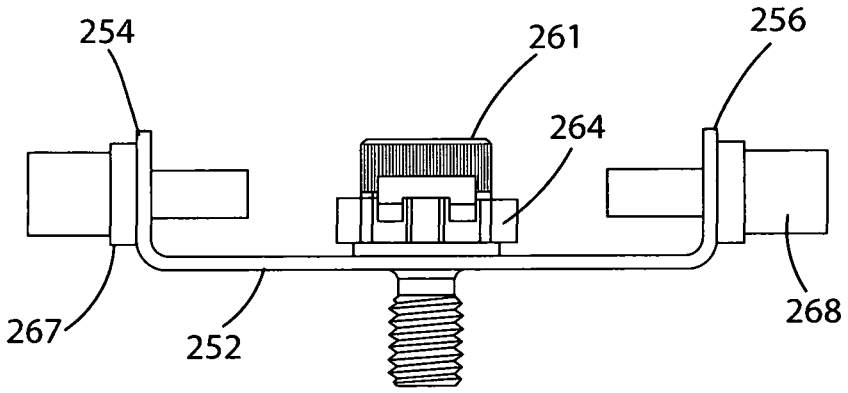
FIG. 33 is a side elevation view of the force transfer mechanism of FIG. 31.

The finger joint fold assembly 300 as shown in FIGS. 24-29 is mounted in the leg segments 163, 163' of the U-shaped lower base frame section 160 allowing the frame to fold. A finger loop 350 as seen in FIG. 23 is used to disengage a sliding lock member 346 on the finger joint assembly 300. When the user desires to fold the frame he or she would pull up on the loop 350 and a connecting line would pull back on the sliding lock member 346 allowing the finger joint assembly to fold. The finger joint fold assembly 300 is formed with a composite body 302 of interlocking male and female segments. The female yoke segment 304 defines a slot 306 cut through the body of the yoke segment which is open at the rear of the yoke segment and a circular aperture 308 which leads from the outside of the yoke prong 307 into the slot 306. Aperture 308 is positioned perpendicular to slot 306 and communicates with slot 306. The aperture 308 receives a bushing 310 which engages a seat on the opposite prong of the yoke and is held in place by a hex socket screw 312. The hex socket screw 312 passes through the bushing 310 and is fastened to a threaded side of the female yoke segment 304. Opposite the slot 306 on the front of female yoke segment 304 is a solid cylindrical shaft member 305 which extends distally from the female yoke segment and is inserted into a tubular leg portion 163' to support and hold the female yoke segment 304 in the leg portion. The shaft member 305 can be friction fit, glued, welded or crimped in the tubular leg portion 163. The yoke prongs 307 are angled at their end and have a rounded upper portion 309 allowing the two segments of the finger joint fold assembly to easily fold.

The male segment 330 is provided with a linear planar front section 331 having an angled planar front surface 333 which is designed to fit in slot 306. The planar front section 331 also has a throughgoing aperture 332 which runs perpendicular to the plane of the front segment 331 and has the same diameter as aperture 308 of the female yoke segment 304 so that it can receive and hold bushing 310 while allowing pivotal movement of the male and female segments. When the front section 331 is seated in slot 306, bushing 310 can be inserted through aperture 308. The bushing 310 is inserted through hole 308 in the yoke segment and through slot 306 as holes 308 and 332 are axially aligned.

The rear portion 335 of the male segment 330 is cylindrical and defines a throughgoing slot 338. The opposite end of male segment 330 adjacent rear portion 335 defines a solid cylindrical end member 336 which is held in tubular leg portion 163 or 163' in the same manner as previously noted. The cylindrical end member 336 holds a compression spring member 342 in its planar distal end which extends rearwards ending in a stop button 344. The stop button 344 is designed to engage the rear wall of cylindrical sliding lock member 346. The sliding lock member 346 receives a tubular sleeve 334 which has an inner diameter greater than the rear cylindrical portion 335 of the male segment 330 and an outer diameter less than the inner diameter of the sliding lock member 346. The tubular sleeve 334 may be provided with a sleeve bearing or alternatively the sliding lock member 346 may be molded with a low friction polymer without the additional sleeve bearing. The sliding lock member 346 is provided with opposing aligned apertures 350 and 351 which are adapted to receive a slotted spring pin 352. The slotted spring pin 352 is inserted through aperture 350 of the sliding lock member through a slot 338 cut through the body of male member 330 into sliding lock member aperture 351 to hold the assembly locked together as shown in FIGS. 25 and 29. The sliding lock member 346 is spring loaded by spring member 342 and when the rollator frame is to be collapsed, the user pulls on a handle mounted on the upright strut member that in turn pulls on a connective cord that is attached to the sliding lock member 346 pulling it back so that pin 352 engages the rear of slot 338. When the sliding lock member 346 is retracted, the finger joint fold assembly 300 can be pivoted allowing the lower base frame section 160 to fold.

Figure 22:
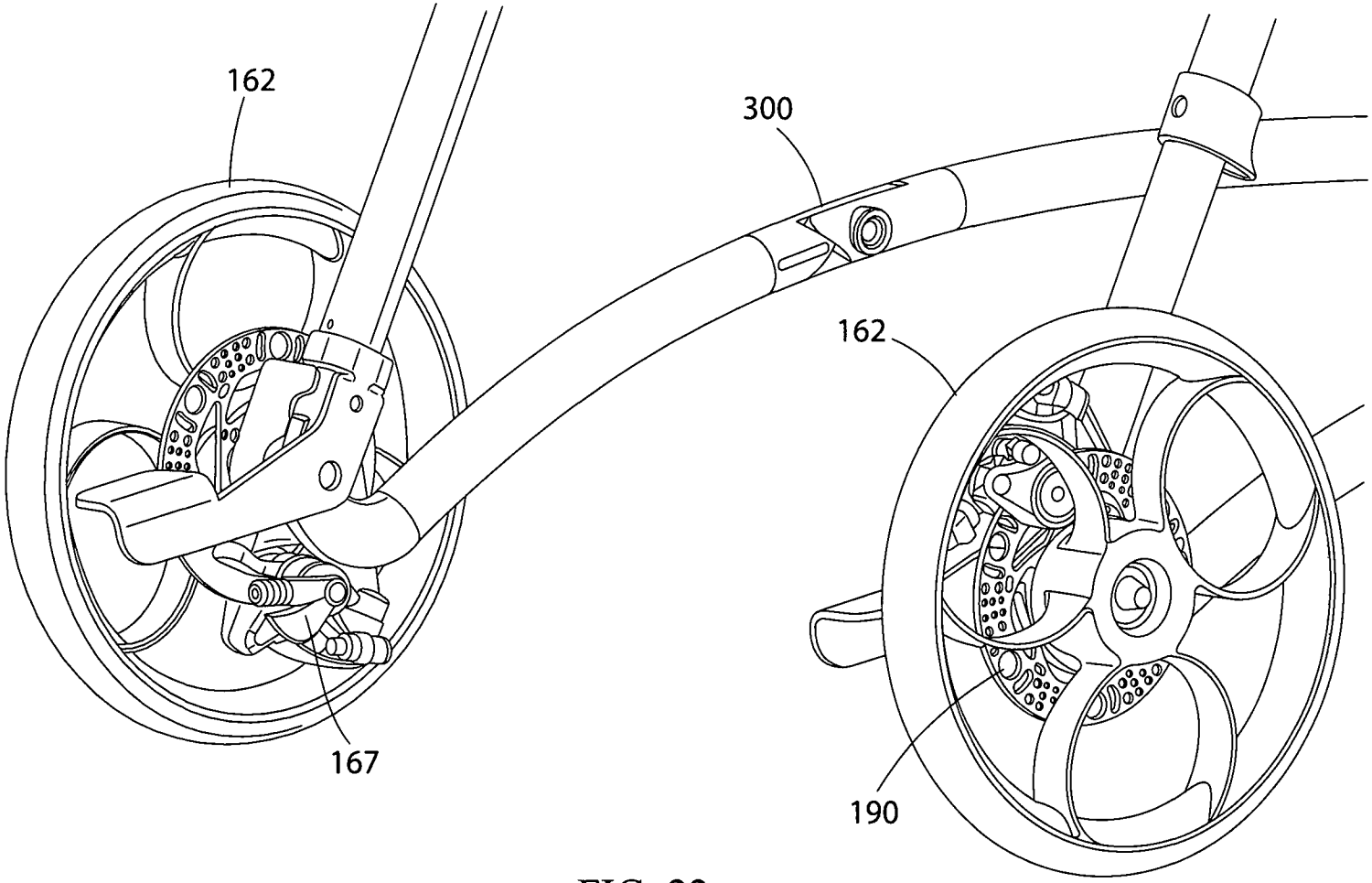
FIG. 22 is an enlarged rear wheel assembly and brake calipers with a lower base frame section shown in phantom.

The user is positioned upright within the rotator frame 152 and the four wheels in a stable orientation. Each brake lever is operatively connected to right and left calipers 167 as seen in FIG. 22 which are synchronized to engage the rotors 190 of the rear wheels 162 as shown.

The invention couples both right and left brakes to a single lever with balanced brake force applied to the rear wheels. The two rear wheel are thus braked evenly with a single hand squeeze of the brake handle. The brake handle may be mounted to either left or right side depending on preference of user. This provides a meaningful functional opportunity for stroke patients who may have issues with the strength or coordination of one side vs the other hand.

One single brake handle lever can be used to apply even balanced braking force to the two rear wheels which provides the following benefits to the user.

In many cases the aged cannot apply the same hand strength on left and right side. In some users one hand may be significantly compromised. Therein, the user must rely on one hand for all tasks that require grip strength.

Figure 21:
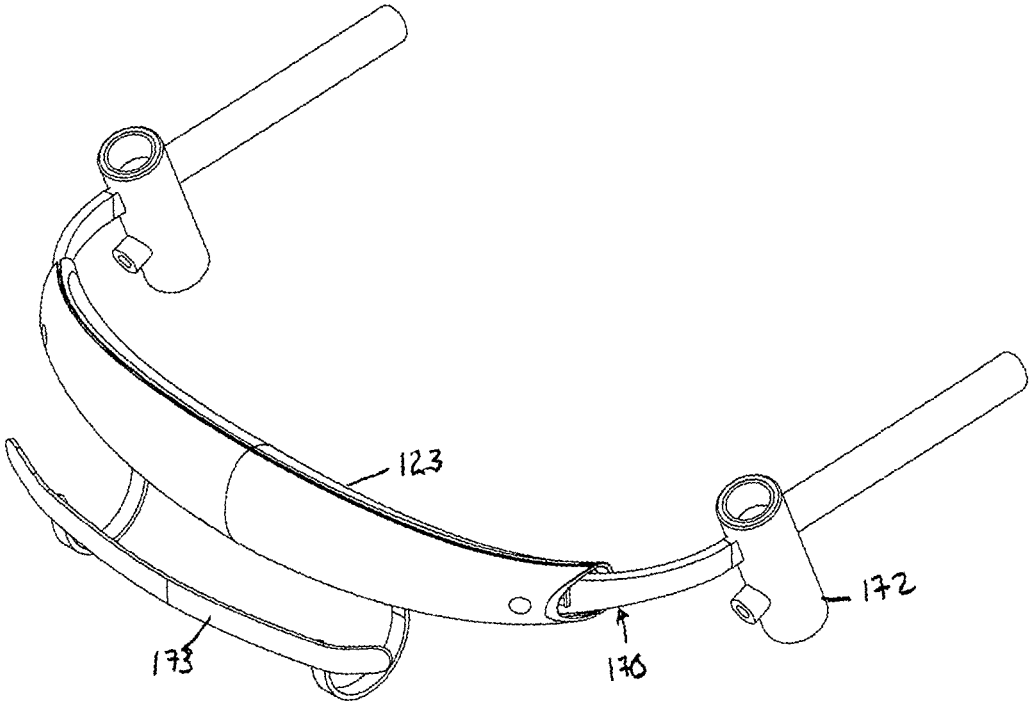
FIG. 21 is an enlarged perspective view of a carry all mount which can be used for the embodiment of FIG. 15.

The handgrip frame member 166 can be adjusted to low, intermediate or high positions. A handle bar/back rest sddrmbly 170 is mounted on the forward surface of upright section 154 opposite handgrip frame member 166. A carry all mount 173 as shown by FIG. 21 can be mounted to the back rest 123.

The brake levers in the first embodiment initially were connected by cables to a rack and pinion assembly which in turn operated the brake rotor on each wheel as is well known in the art. The handle levers in all three preferred embodiments are optionally connected to a bell crank or force transfer mechanism 250. The bell crank mechanism 250 as shown in FIGS. 30 through 33 is mounted on the rollator frame. The bell crank or force transfer mechanism comprises a linear support plate member 252 having an upturned flange 254 and 256 at each end and a rotatable bell crank member 260 mounted to the center of the linear support plate member 252. Clamps 262 and 264 are mounted on each end of the bell crank member 260 and are used to secure brake cables to the bell crank member 260. The force transfer mechanism or bell crank 250 is mounted by a set screw 261 to the linear support plate 252 which acts as a pivot post for the bell crank on the plate or linear support member. Each flange is provided with two cable mounts 265, 267 and 266, 268 which are axially aligned and receive the cables connected to a respective brake lever and to the brake caliper.

The cable from the right brake lever is mounted in cable mount 266 and the cable to the right brake caliper is mounted in cable mount 268. Both cable mounts 266 and 268 are mounted to flange 256 and their respective cables are secured to clamps 262 and 264 of the bell crank member 260, respectively. The cable from the left hand brake lever is mounted in cable mount 267 and the cable to the left brake caliper is mounted in cable mount 265. Both cable mounts 266 and 268 are mounted to flange 256 and secured to the opposing respective clamps of the bell crank member as shown.

Figure 34:
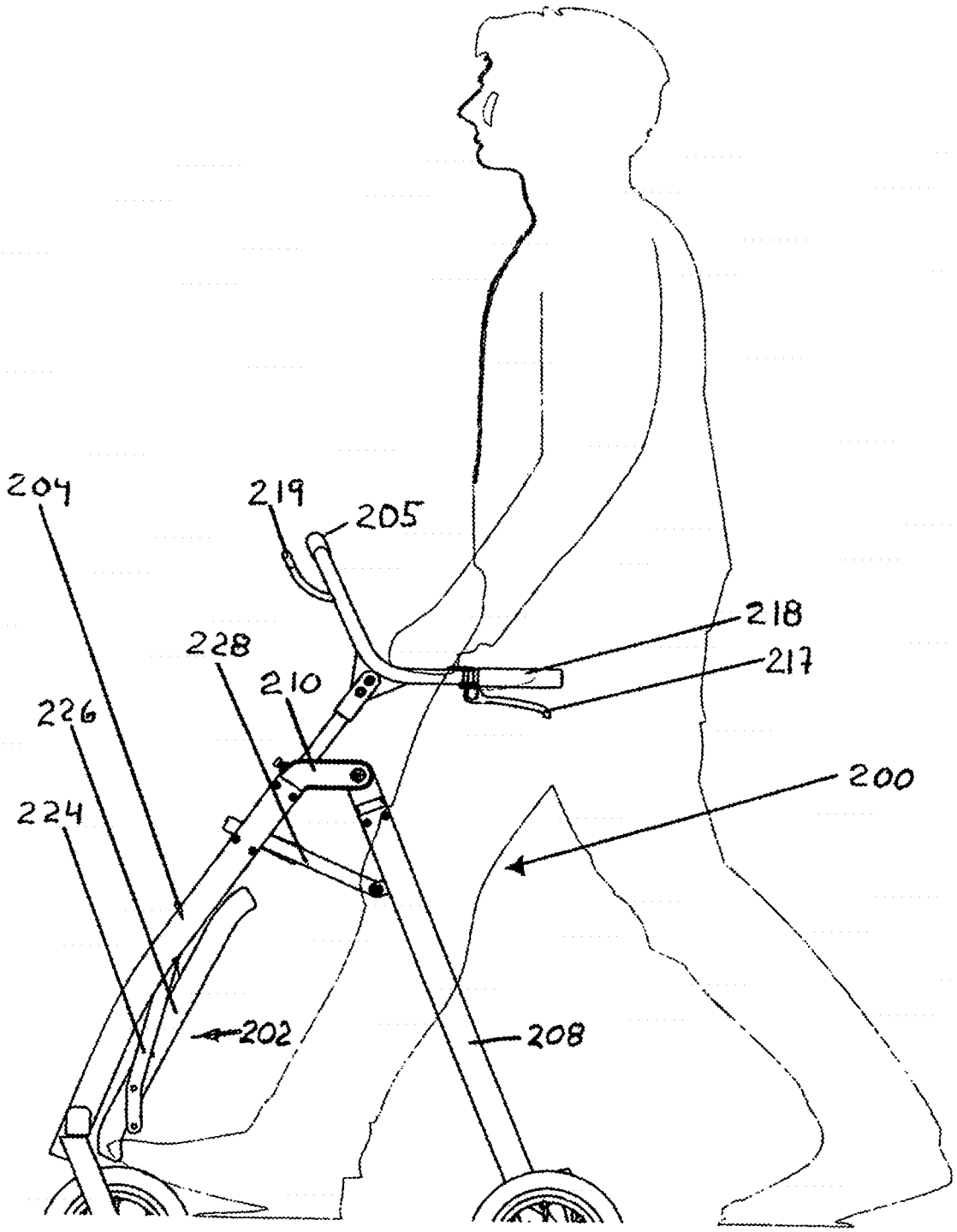
FIG. 34 is a side elevational view of yet another embodiment of the rollator with the seat retracted showing the user in phantom.
Figure 35:
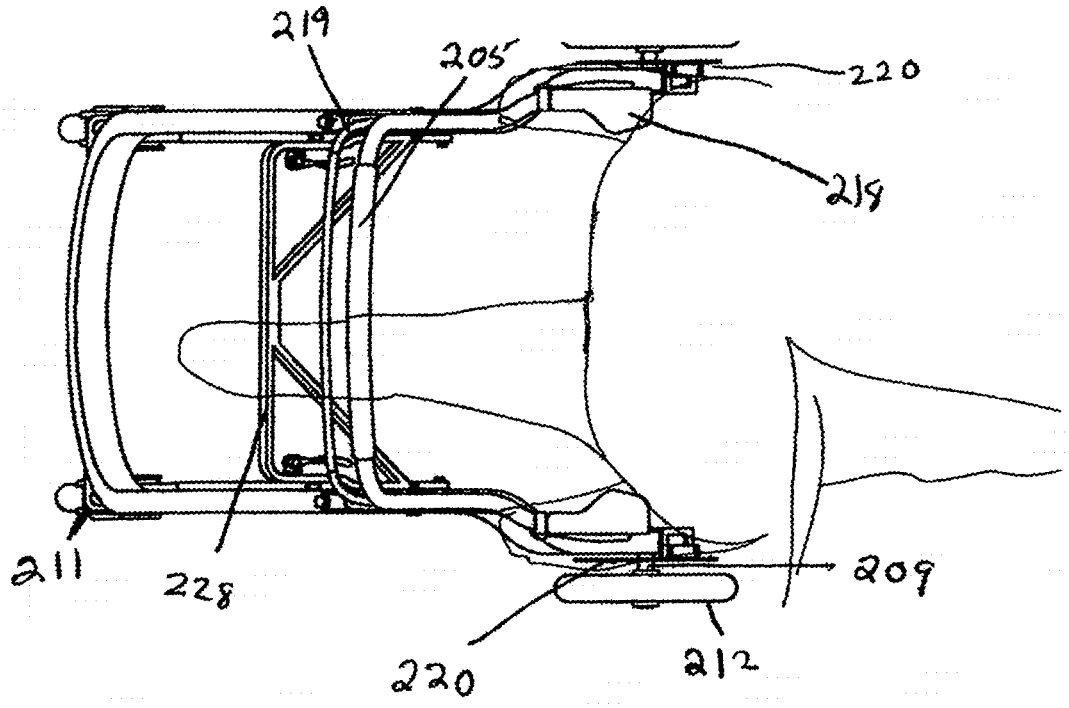
FIG. 35 is a top plan view of the third embodiment shown in FIG. 34 with the seat removed.
Figure 36:
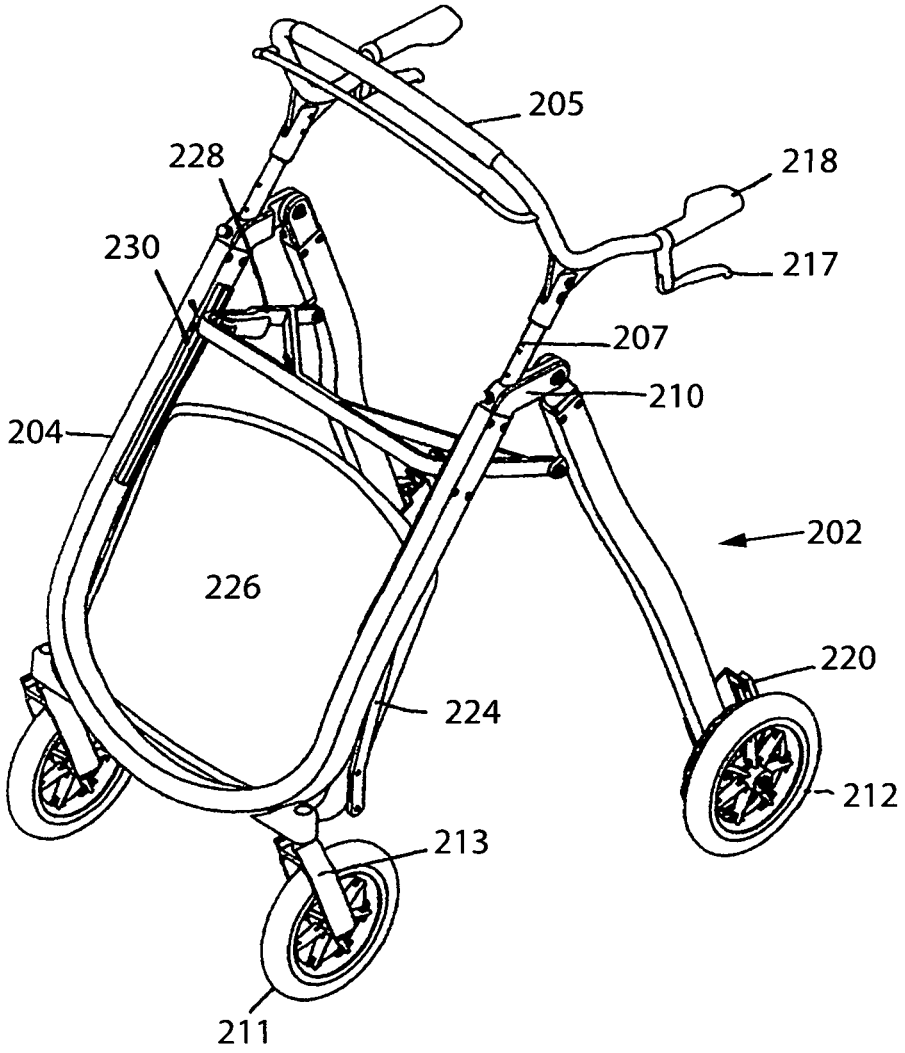
FIG. 36 is a perspective view of the third embodiment rollator with the seat in the retracted position
Figure 37:
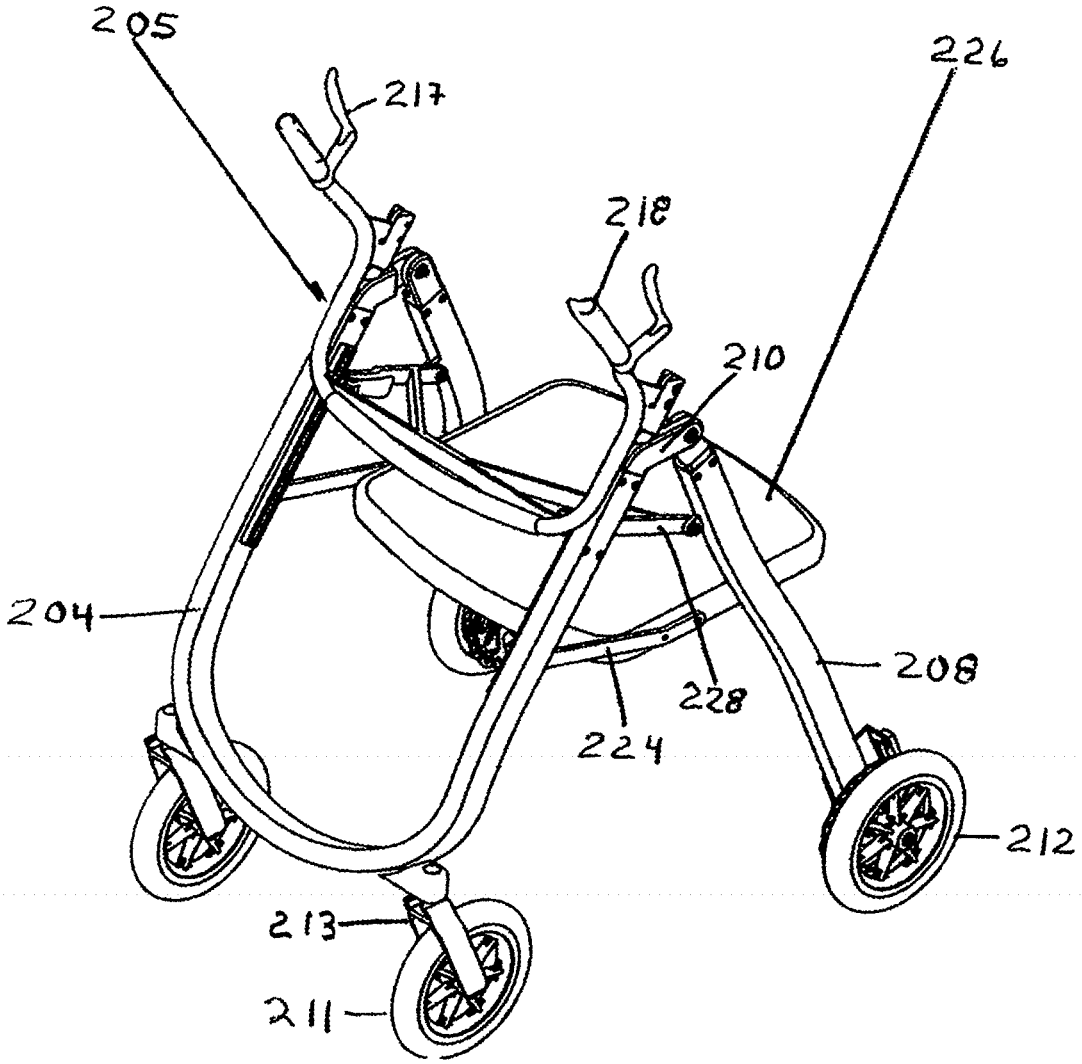
FIG. 37 is a perspective view of the third embodiment rollator with the seat in a seating position.
Figure 38:
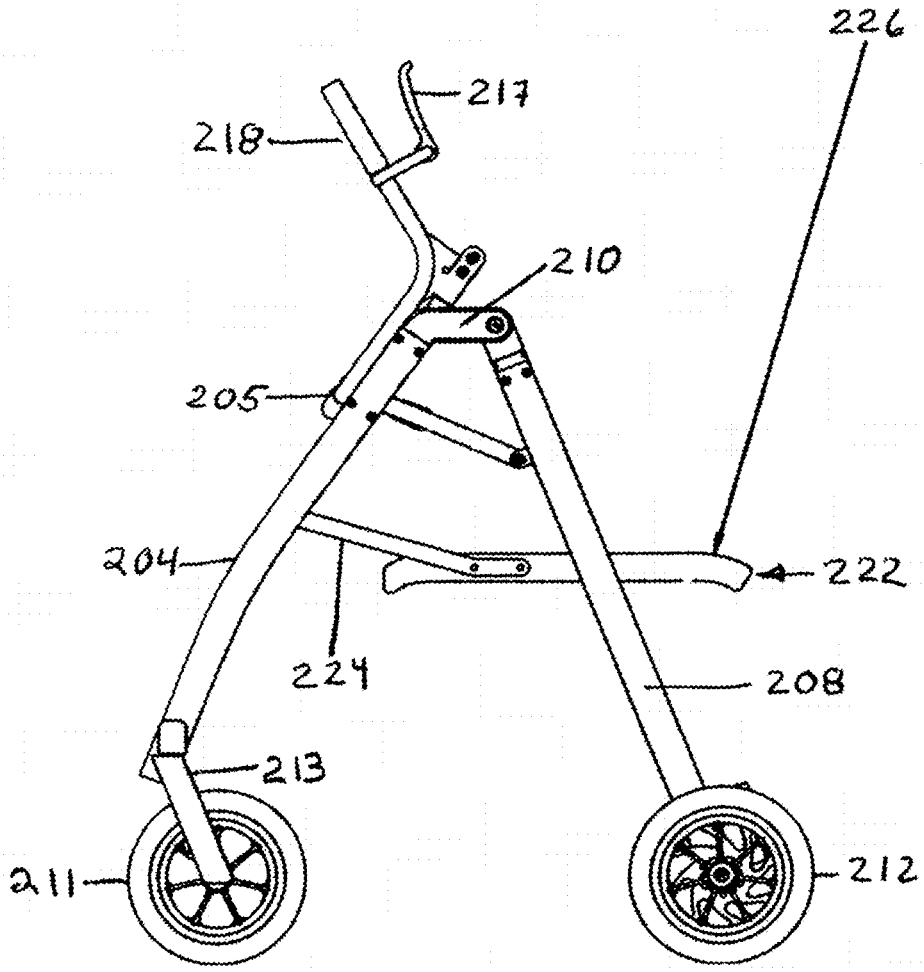
FIG. 38 is a side view of FIG. 37.
Figure 39:
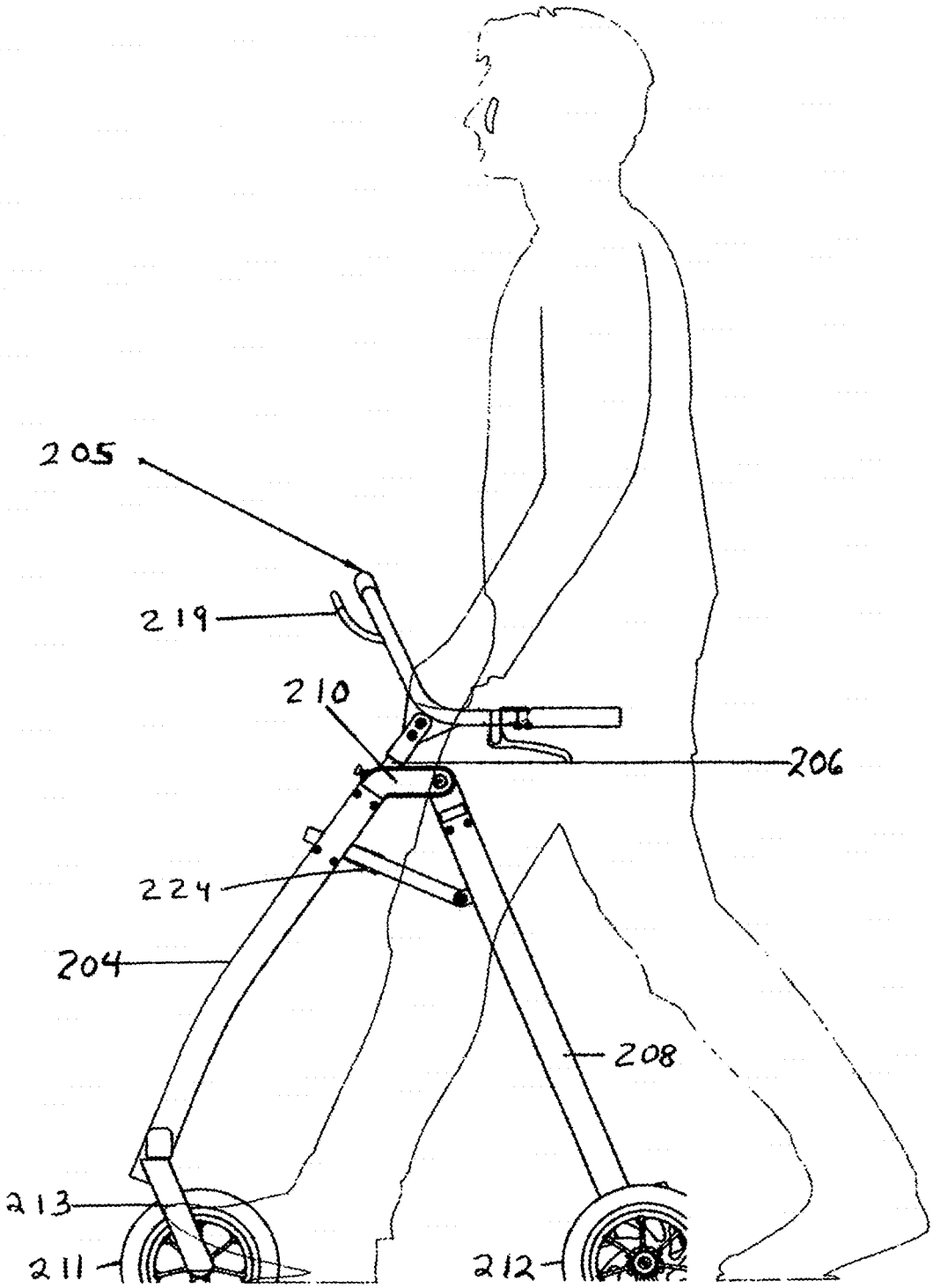
FIG. 39 is a side view of the embodiment of FIG. 34 of the rollator with the seat removed and the handgrip frame adjusted to the lowest position and the user in phantom.
Figure 40:
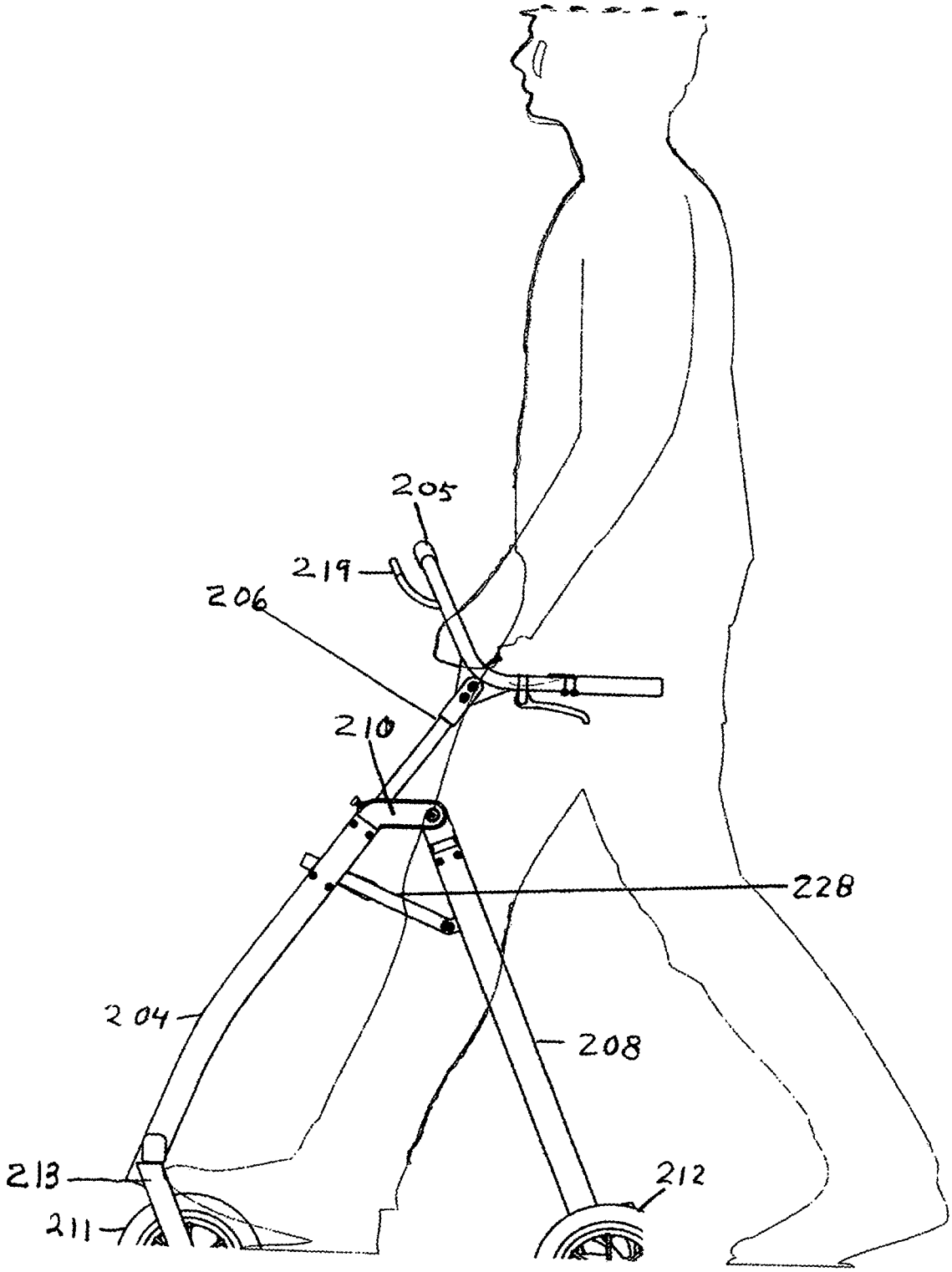
FIG. 40 is a side view of FIG. 39 with the handgrip frame adjusted to the highest position and the user in phantom.

The rollator can be provided with a seat frame 176 having a slide mechanism 174 positioned on each side of seat frame 176. The slide mechanism 174 comprises a clip member 175 secured to the seat frame 176 and a slideable sleeve member 177 secured to the clip member 175 as seen in FIG. 23. The sleeve member 177 engages and slides along leg 164 allowing the seat frame 176 to be retracted as seen in FIGS. 34 and 36 or positioned midway or opened for seating as shown in FIGS. 37 and 38. Further, support is provided by the pivot linkage which is more clearly shown in FIGS. 16A and 18.

In another third preferred embodiment of the rollator 200 as shown in FIGS. 34 through 47, a multi-sectional coupled frame 202 is provided with a generally U-shaped upright main frame section 204 angled away from the vertical toward the user so that the user is centralized and standing upright which provides balance and stability to the user. A U-shaped handgrip assembly 205 is mounted to the top of the main frame section 204 The handgrip assembly 205 can be extended for walking as shown in FIG. 34 or folded over for sitting as seen in FIG. 37. Rear legs 208 are mounted to an angled connector member 210 which in turn is secured to U-shaped upright main frame section 204. Each rear leg 208 holds or supports an axle 209 which holds rear wheels 212. Pivoting front wheels 211 are mounted in yokes 213 which are in turn mounted to the U-shaped base of upright frame 204. Thus, the user is positioned upright within the four wheel base in a stable orientation.

Figure 41:
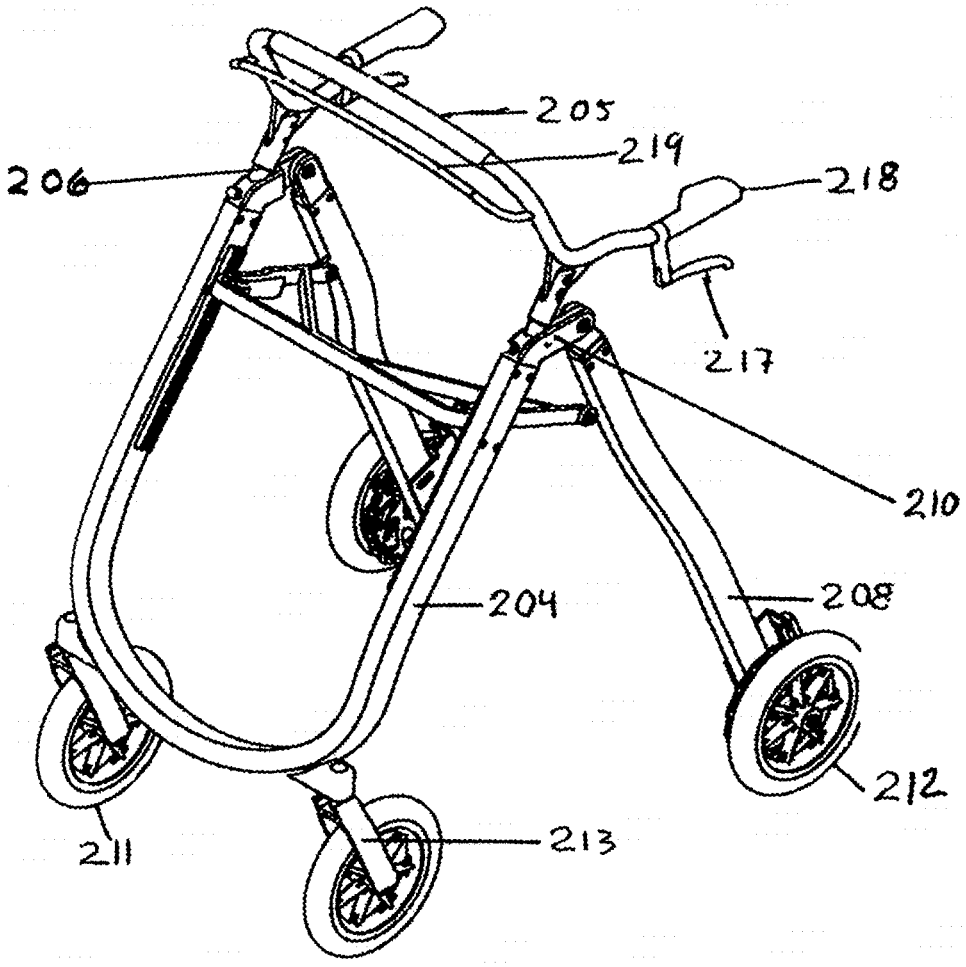
FIG. 41 is a front and side perspective view of the rollator embodiment as shown in FIG. 39.
Figure 42:
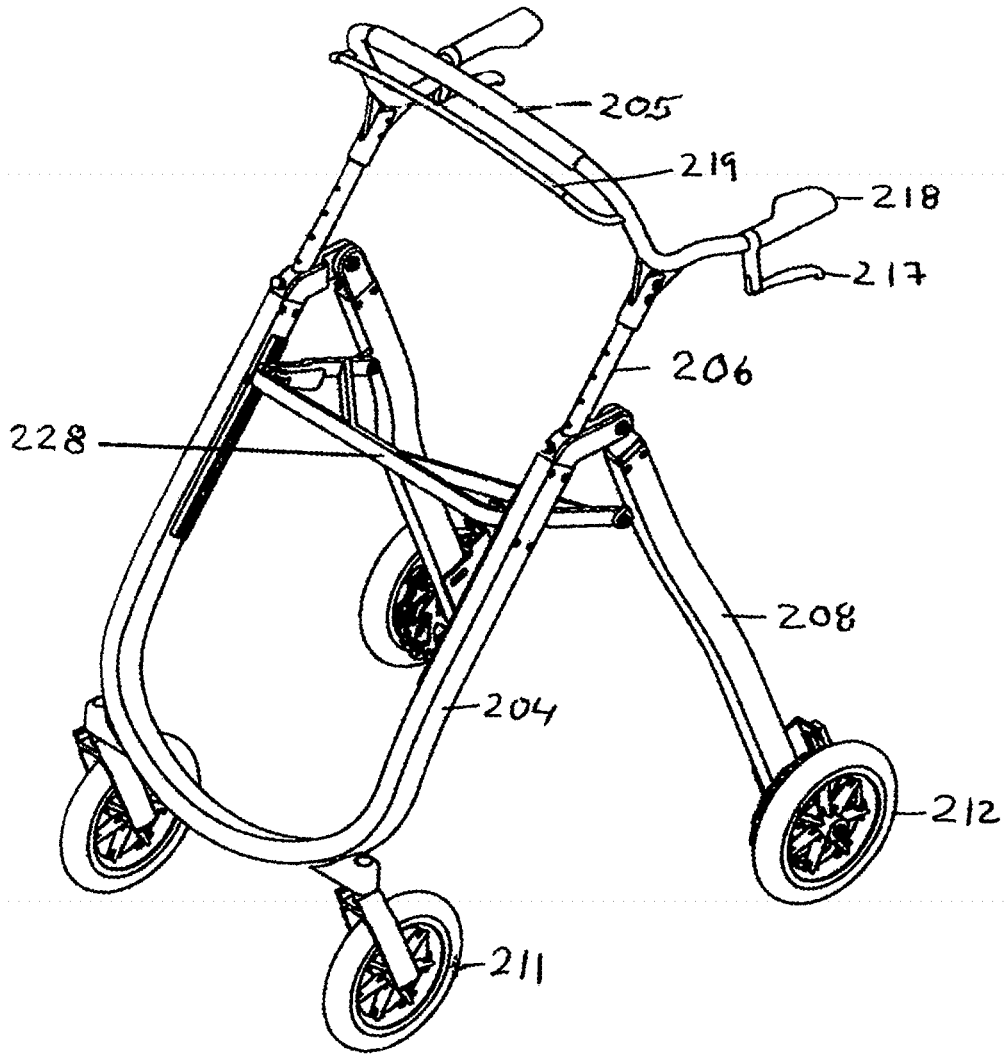
FIG. 42 is a perspective view of the rollator embodiment shown in FIG. 40.
Figure 43:
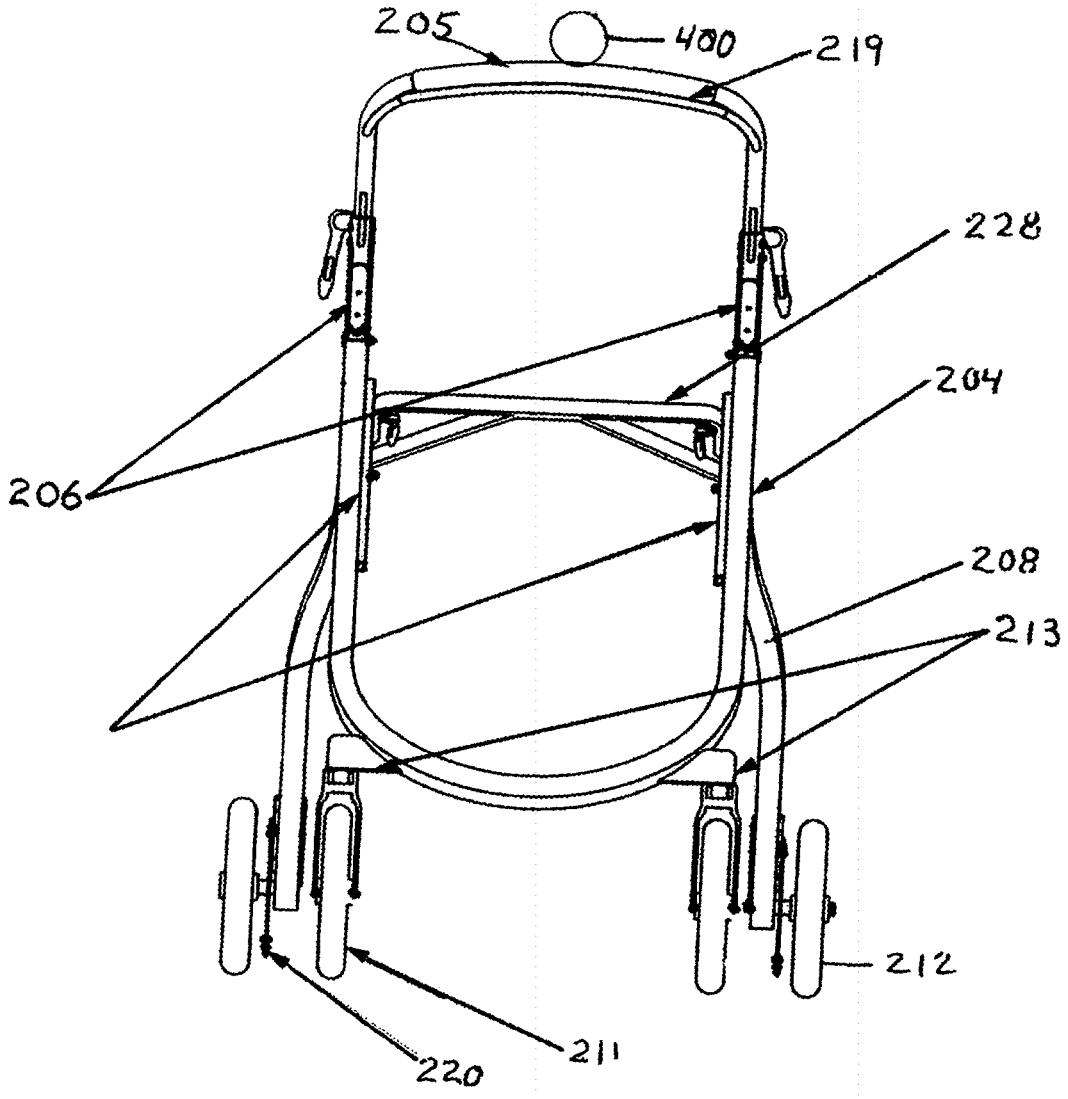
FIG. 43 is a front elevational view of the rollator embodiment of FIG. 40 showing a schematic odometer.
Figure 44:
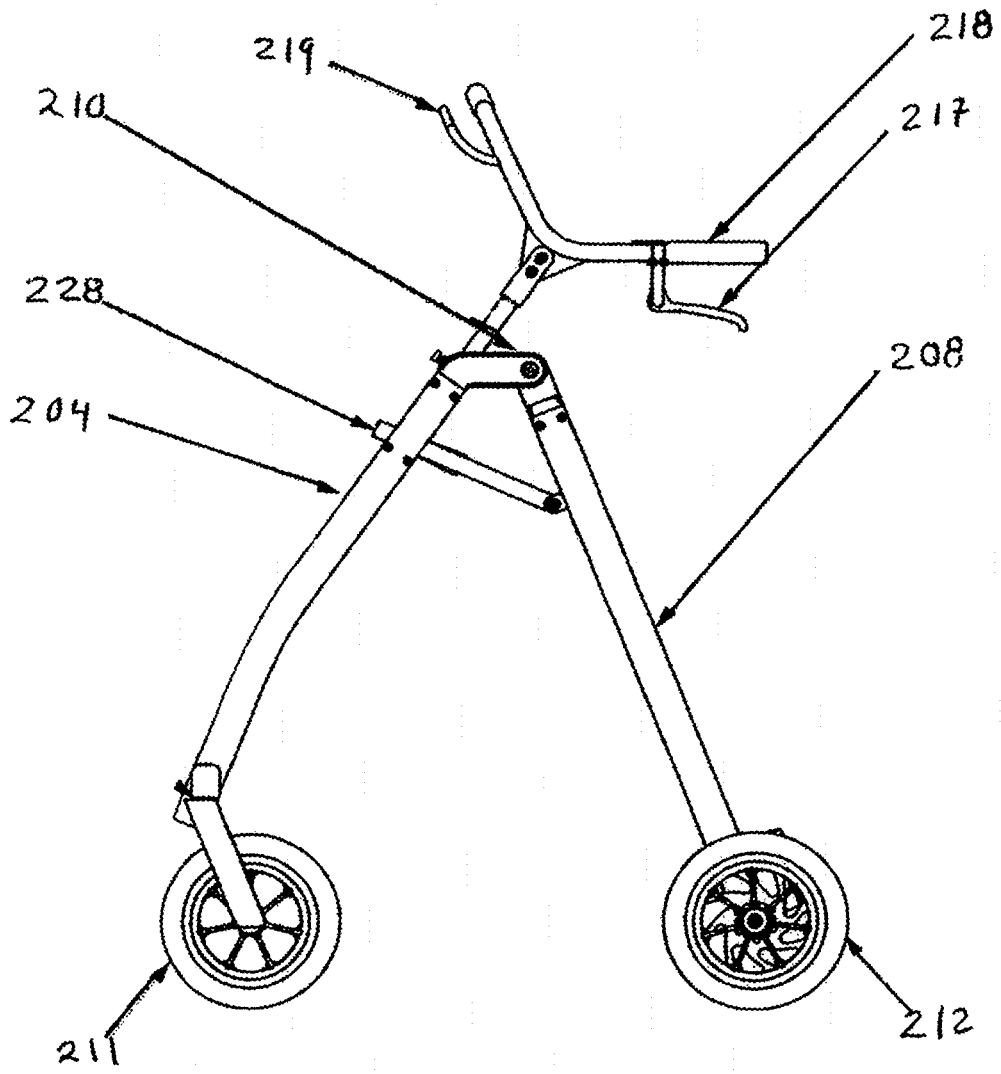
FIG. 44 is a side view of the rollator embodiment as shown in FIG. 43 without an odometer.
Figure 45:
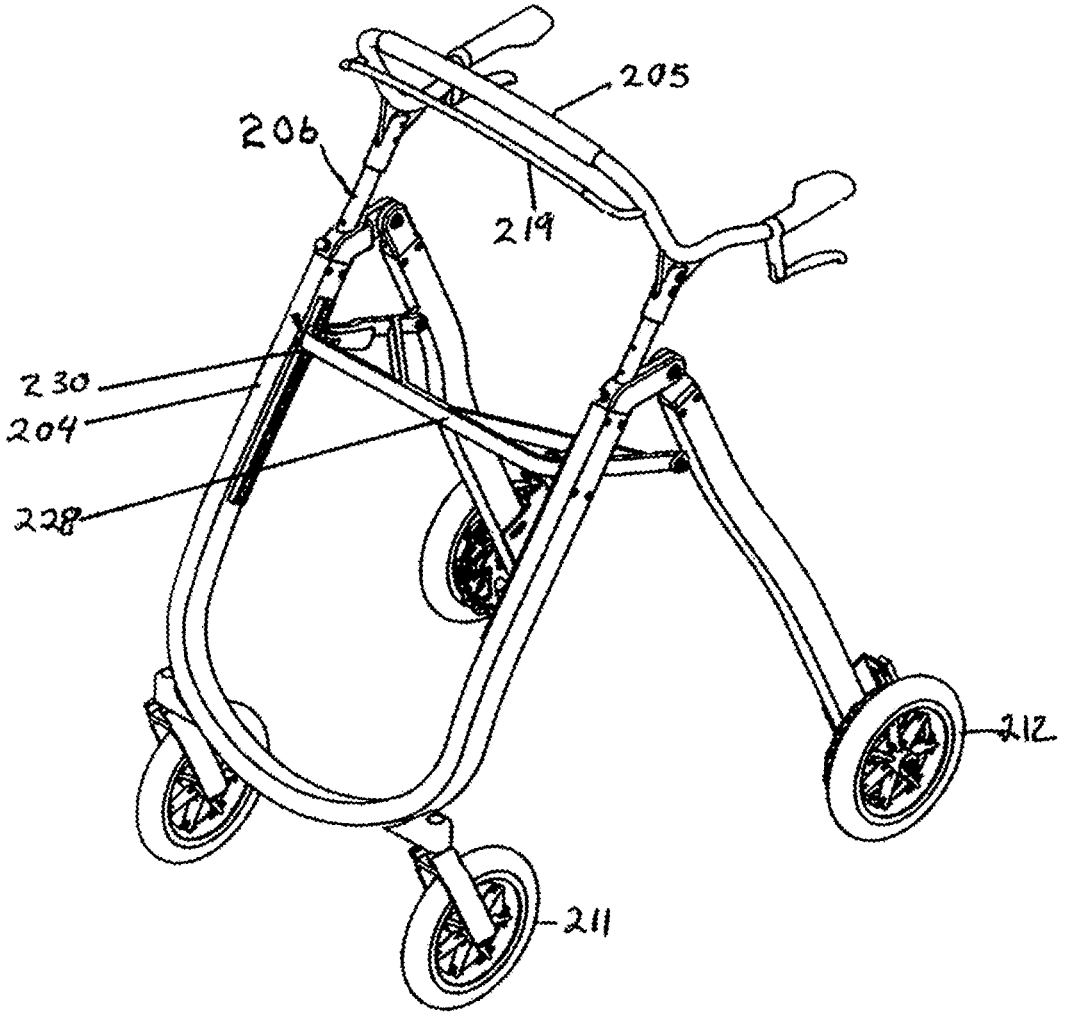
FIG. 45 is a front and side perspective view of the rollator embodiment shown in FIG. 44.
Figure 46:
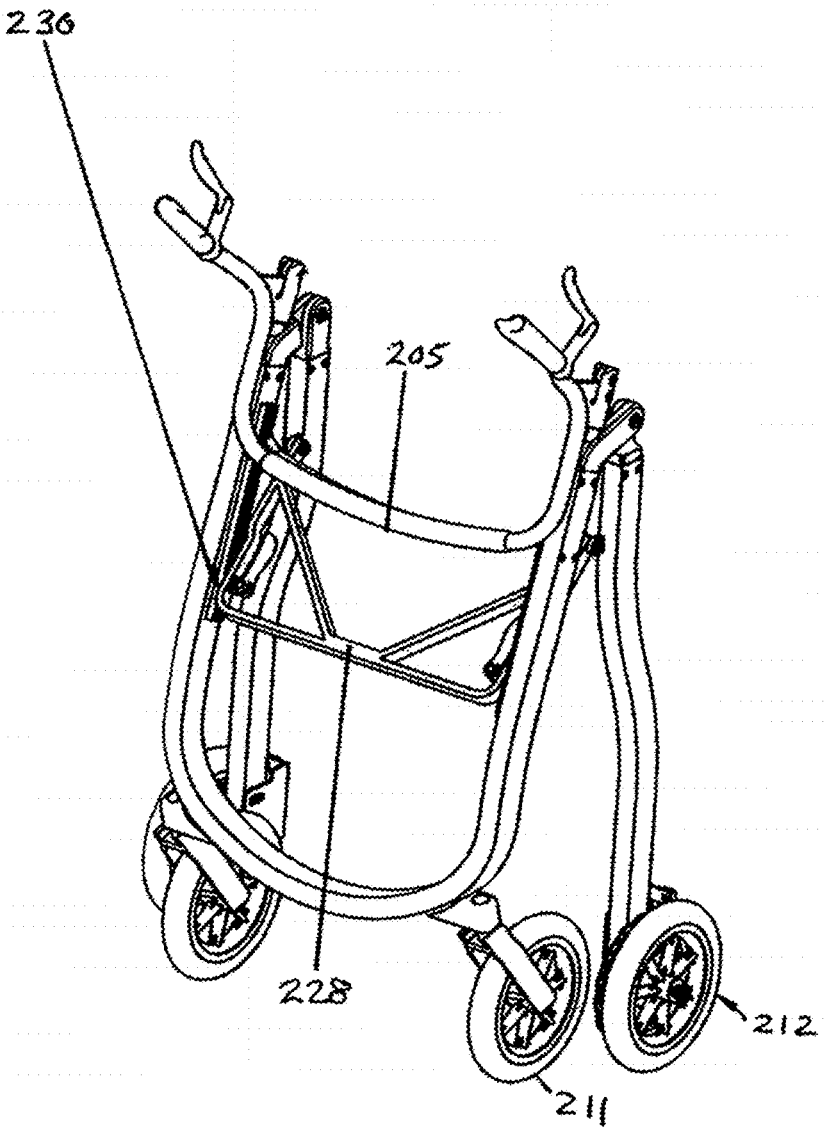
FIG. 46 is a frontal perspective view of the rollator shown in FIG. 45 in a folded position.
Figure 47:
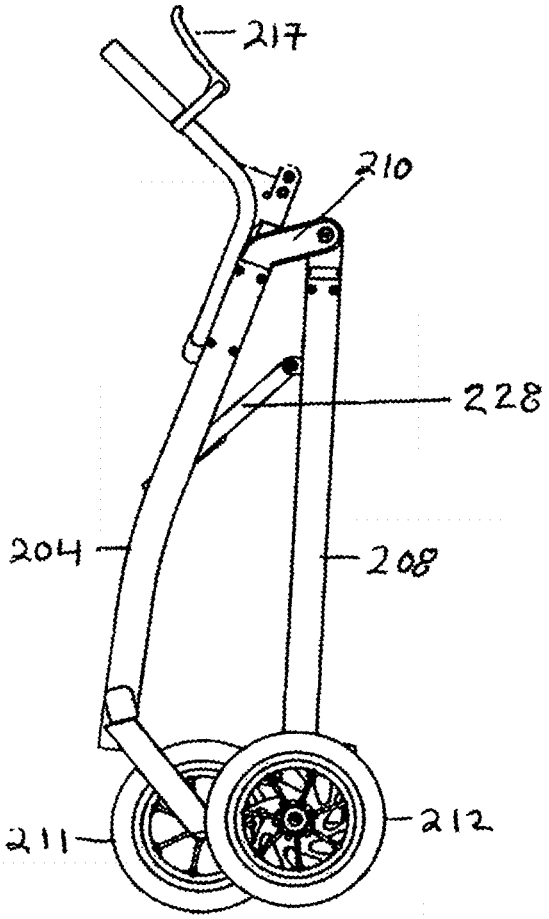
FIG. 47 is a side elevational view of the rollator shown in FIG. 46.
Figure 52:
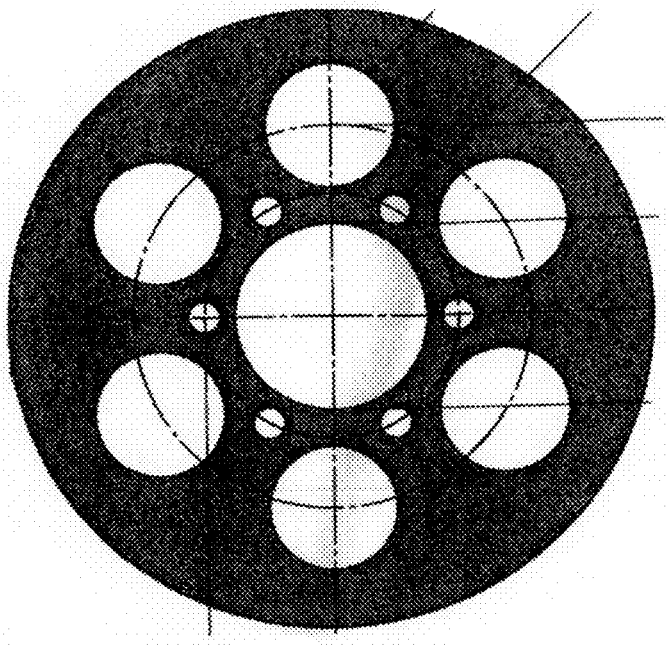
FIG. 52 is a plan view of a brake rotor which can be used with the rollator.

A handgrip assembly is mounted to each side of top section handgrip assembly 205 with the distal end of top section 205 being provided with a brake lever 217 and a handgrip 218 positioned adjacent to the brake lever 217. Each brake lever 217 is respectively connected to right and left rotors 220 which are synchronized together with the associated calipers to brake the rear wheels of the rollator 200. The top section assembly 205 can be adjusted as seen in FIGS. 41-43 to assume low, intermediate or high positions by raising or lowering it with respect to top section legs 206 from their prior set position on legs 206. A transverse push bar brake lever 219 mounted on the upright section 205 is also synchronized with the handgrip brakes.

The rollator 200 can be provided with a seat assembly 222 as shown in FIG. 38 and is mounted to pivoting linkage members 224 which are pivotally mounted to the upright frame 204 and to the opposite sides of seat frame 226 or associated seat frame. This allows the seat 226 to be retracted or opened for seating. Folding braces 228 provide for additional support between the main frame section 204 and the legs 208.

Each rollator frame can additionally be provided with an odometer 400 schematically shown in FIG. 43, to measure walking distance for objective therapy documentation and to chart user improvements over time so that a physical therapist may apply walking objectives that change over time. The physical therapist may need quantified measurement of distances travelled over time for clinical documentation and patient charting. The odometer provides a practical and simple means to obtain this data and use that data over time to see trending and changes and lighting.

As previously noted, the rear brake wheels of the invention on any of the embodiments may be of the standard rotor and caliper type but can also incorporate the rear brake wheels as shown by FIGS. 48 through 51. FIGS. 48 and 51 show the rear wheel 280 with a wheel hub 282 and associated socket 287 provided with a bearing race 283. Circular spokes 284 which are dished 285 (See FIGS. 48 and 51) to allow the brake rotor 286 to nest adjacent the wheel hub 282. A low profile tire 288 is mounted around the wheel rim 290 and may be comprised of solid rubber or copolymer as desired. The spokes 284 part of the overall injected molded wheel hub and are made of rigid plastic. Alternately the spokes 284 are preferably made of flat strips of stainless steel which are bent to form a circular shape or cut to form a circular shape with one side of each circular spoke being secured or integral to the wheel hub 282 and the opposite side being secured to the inner rim surface 291. The round spokes 284 provide a spring effect which cushions the wheel and eliminates jarring to the user. The wheel hub 282 contains a bearing assembly 283 which is mounted inside the hub socket 287. The hub socket receives a shaft or axle which extends from the rear legs of the rotator frame.

Integrated lighting 410 as shown by FIGS. 5 and 6 can be provided on any designated rollator embodiments noted herein for downward, and or forward projecting illumination. Two types of illumination are available in this upright mobility device to enable the user to see in different light environments. One environment may be outdoors when ambient lighting is insufficient to provide clear visualization forward or downward while walking on a travelled pathway; examples may be a sidewalk, a dirt path, a country road, a backyard, etc. Another environment is indoors at one's home, for example, when the room lighting is turned off or simply not available. In this condition, downward directed flood lighting projects a soft pool of light around the perimeter of the upright mobility device. This illumination enables the user to see around the perimeter of the upright mobility device and provide sufficient illumination to enable one to walk down a hall way or through a room without turning on the room lighting in that space.

The use of conventional rolling walker grips with horizontal handles allows the rollator to be steered by pushing or pulling on respective handles as needed. The conventional walker is also designed to provide a place for the user to sit and rest as needed or desired. In the present invention, a backrest member connected with the main frame supports the user's back when the user is setting down.

The knee joint is one of the primary and most affected joints of the user that takes part in the standing position. Other joints that are involved in the standing position are the hip, ankle, knee, elbow, wrist and shoulder joint. The knee joint gets the most strain, and the knee joint is comparatively less supported. That is why usually it is the knee joint that first starts to signal pain because of arthritis. Knee joint arthritis causes long term knee pain, which makes the movement difficult at knee joint. Arthritis also makes the knee joint stiffer and slower and its range of motion also decreases. All these conditions make it difficult to stand up from a sitting or squatting position.

A seat is utilized in the embodiment of the present invention which is higher than the standard 18 inch distance from the floor to the seat top. The rollator offers a 20 inch to 22 inch seat height size to accommodate different users. In testing it was fond that for some users it was helpful to stand up from a seated position, but for more able body users it was less comfortable for longer term seating. The seat is provided with a flexible forward edge seat pan to assist the user to transition from a seated to a standing posture. As a person ages, they may lose the strength and balance affecting their ability to stand upright from a traditional chair. The seat of a standard chair is too low to the floor which results in a compromised biomechanical disadvantage as one ages. The seat is increased to 22 inches to improve the conditions for standing from a seated position. This elevated seat pan height changes the angle between the user's buttocks and lower leg to be greater than 90 degrees. The user's thighs are angled downward relative to the floor, initiating the first transition to standing. To further enhance this posture the seat pan is flexible and spring-like along the forward edge of the seat. The flexing feature added to the inventive seat engages the forward edge of the seat pan. The forward edge will flex upward as the seated person begins to stand up providing a contact area that remain with the user until the user is in a upright balance posture.

The present inventive device offers the following important features:

- Low cost because of minimal parts.
- Frame is strong and stable.
- Frame is constructed of simple sections which can be easily and economically repaired or replaced.
- The seat frame has a groove detail that runs along the perimeter of the frame.
- Seat frame is one piece injected molded reinforced plastic frame.
- A specialized woven polymer mesh is stretched across the seat frame with specified softness and compliance to make the seat pan have a tighter tension or a looser tension
- The seat frame swings out of the open frame to clear the area for the user to stand and walk with full normal gait.
- Frame is of open construction which does not impede or alter a natural full gait cycle or an upright standing posture.
- Upright support bar enables user alternatives for grip posture, support, and balance. The upright support bar encourages full gait cycle, encourages upright standing posture. The upright support bar will also serve as a leaning/resting bar; allowing the user to take a break from walking and rest on the bar and also allows the user to open doors with one hand and maintain support with other hand.
- Upright support bar provides a convenient (push from behind) handle. This feature comes into play when a person is seated in the rollator and is being moved about by another person pushing the rollator.
- Frame is foldable to enable storage and transport including transport in car trunk.
- Two types of ground plane illumination 410 are provided with high and low lighting levels. The light 410 schematically shown in FIGS. 5 and 6 can be utilized in any of the embodiments can be mounted on the upright frame section or across the upright frame legs
- A retractable seat can be retained in a position that does not impede upright walking position.
- Brake handle is modified for use by either hand to provide even braking force to both wheels.
- Traverse brake bar positioned parallel to upright support bar. User may apply brake while pushing rollator from upright support bar. This is additional brake activation control.
- Single lever brake system which may be locked and utilized as parking brake. It engages and/or disengages both rear wheels; a safety feature which prevents accidental rolling while seated in the rollator.
- An added accessory rail can accommodate carry bags, an illumination bar, cup holder, phone caddy, distance and speed computer and other desired add-on features located within any an arm's reach of the user.
- Brake resistance can be modified to manage the level of resistance to move the rollator.

Height adjustable handgrips.

Solar panel 420 (not shown) for battery charging. This panel can be mounted on the intermediate frame section on either leg or across both legs Odometer 400 provides objective documentation of user activity for physical therapy.

Elevated seat pan changes angle between buttocks and lower leg.

The principles, preferred embodiments and modes of operation of the present invention have been described in the foregoing specification. However, the invention should not be construed as limited to the particular embodiments which have been described above. Instead, the embodiments described here should be regarded as illustrative rather than restrictive. Variations and changes may be made by others without departing from the scope of the present invention as defined by the following claims:

What we claim is:

1. A rollator designed to maintain stable and erect body posture of a user and allow a full gait of the user, comprising a foldable height adjustable frame assembly constructed with a U-shaped upright frame section, a U-shaped base frame section mounted to said upright frame section, an intermediate frame section mounted to said upright frame section and said base frame section, said lower base frame section being provided with folding means allowing it to be folded toward said upright frame section, a plurality of rear wheels mounted to said frame assembly, a plurality of pivotable front wheels mounted to said frame assembly, a brake assembly connected to said upright section and operatively connected to said rear wheels for braking said rear wheels and a pivotable seat assembly mounted to said frame assembly for retraction of said seat assembly forward along said intermediate frame section opening up an sided frame area for the user to stand upright and walk ,said seat assembly including a seat moveably mounted to said intermediate frame section, said seat being adapted to be opened into a seating position and closed into a retracted position, said seat when positioned in seating position being adjustable to a variable height .

2. A rollator as claimed in claim 1 wherein said frame sections are constructed of tubular members and said frame assembly defines an interior open area formed by said U-shaped upright section, said U-shaped base frame section and said intermediate frame section which allows upright entry by said user.

3. A rollator as claimed in claim 1 wherein said U-shaped base section has a plurality of pivotal yoke assemblies mounted thereto, said front wheels being mounted in said pivotal yoke pivotal assemblies.

4. A rollator as claimed in claim 1 wherein said braking assembly includes a plurality of brake levers operatively connected to said rear wheels, each brake lever being able to selectively brake, said rear wheels with equal braking force.

5. A rollator as claimed in claim 1 wherein said upright main frame section and said base frame section are pivotal with respect to each other.

6. A rollator as claimed in claim 1 wherein said brake assembly is mounted on said frame and connected to said rear wheels, said brake assembly comprising a rotor, a caliper and force transfer means driven by said brake assembly.

7. A rollator as claimed in claim 1 wherein light means is mounted on said frame to provide at least two types of illumination.

8. A rollator as claimed in claim 1 wherein said U-shaped upright frame section has an odometer mounted thereto.

9. A rollator as claimed in claim 1 wherein said folding means is a folding mechanism mounted in a leg of said base frame section allowing the base support frame section to be folded.

10. A rollator designed to provide low-radius rotational mobility while a user is engaged in motion, comprising a foldable frame assembly allowing a user to have a natural full gait, said foldable frame assembly comprising an angled upright frame section, a U-shaped base frame section having a plurality of legs connected to said angled upright frame section, each base frame leg being provided with a finger fold joint assembly comprising two pivotal segments, a female yoke segment and a male segment which is inserted into and pivotally fastened to said female yoke segment, a slideable locking sleeve assembly is slidably mounted over said male segment to prevent said female yoke segment and male segment from pivoting and an intermediate frame section mounted to said angled upright frame section and said base frame section, a retractable seat assembly is mounted to said intermediate support assembly, a pair of rear wheels are mounted to said frame assembly, a pair of pivotal yoke mechanisms are mounted to front of said frame assembly, a front wheel is rotatably mounted in each said yoke mechanism, a brake assembly is mounted to said frame assembly and is operatively connected to said pair of rear wheels to provide equal braking force to each of said rear wheels, a plurality of handle assemblies mounted to said angled upright frame section, each handle assembly including a handle bar and a hand grip brake lever, each of said brake levers is adapted to transfer force from said user to a force transfer mechanism to which evenly transmit force to both brake rear wheels.

11. A rollator as claimed in claim 10 wherein said upright frame has a support bar mounted thereto which provides a push handle.

12. A rollator as claimed in claim 10 wherein said base frame is U-shaped with two extending legs, each leg being connected to said upright frame section.

13. A rollator as claimed in claim 10 wherein said rear wheels comprise a wheel rim, a wheel hub mounted inside said wheel rim, a plurality of circular configured spokes mounted to said wheel rim and to said wheel hub and a tire mounted on said wheel rim.

14. A rollator designed to provide low-radius rotational mobility while a user is engaged in motion, comprising a foldable frame allowing a user to have a natural full gait, said foldable frame comprising an angled upright height adjustable U-shaped main frame section, a base U-shaped frame section mounted to said angled upright U-shaped frame and a U-shaped intermediate frame section mounted to said angled U-shaped upright frame section and said U-shaped base frame section, a seat assembly moveably mounted to said U-shaped support assembly, a pair of rear wheels mounted on axles which are mounted to said frame and a pair of pivotal yoke assemblies mounted to said frame, front wheels rotatably mounted to said yoke assemblies, a brake assembly mounted to said frame, said brake assembly being connected to said pair of rear wheels to brake said rear wheels, said brake support assembly including a handle bar assembly mounted to said angled upright main frame section, a hand grip lever mounted on said handle bar assembly, and at least one transverse brake bar mounted on said handle bar assembly, each of said brake levers and brake bars being adapted to transfer force from said user to evenly brake said rear wheels.

15. A rollator as claimed in claim 14 wherein said frame includes an assembly rail for accommodating one or more of a group consisting of carry bags, illumination bar, cap holder, phone caddy, distance and speed computer.

16. A rollator as claimed in claim 14 wherein said brake assembly has height adjustable hand grips and has a seat height which causes the angle between the user's buttocks and lower leg to be greater than 90°.

17. A rollator as claimed in claim 14 wherein said frame has ground illumination means mounted thereon, said ground illumination means providing high and low lighting levels.

18. A rollator as claimed in claim 14 wherein said frame has solar panel battery charging means mounted therein.

19. A rollator designed to maintain stable and erect body posture of a user and allow a full gait of the user, comprising a foldable height adjustable frame assembly constructed with a U-shaped upright frame section, a U-shaped base frame section mounted to said upright frame section, an intermediate frame section mounted to said upright frame section and said base frame section, said lower base frame section being provided with folding means allowing it to be folded toward said upright frame section, a plurality of rear wheels mounted to said frame assembly, a plurality of pivotable front wheels mounted to said frame assembly, a brake assembly connected to said upright section including a brake lever on each arm, said brake levers applying an evenly balanced force to said rear wheels even when the force applied to each of said brake levers is uneven, said brake levers being connected to said rear wheels for braking said rear wheels, a seat is moveably mounted to said intermediate frame section and adapted to be opened into a seating position and a closed retracted position, said seat when in the seating position being adjustable to a plurality of selected heights from the ground surface, said moveable seat being mounted to said frame assembly for retraction of said seat along said intermediate frame opening; said frame assembly when said seat has been retracted allowing the user to stand upright and walk with a full even gait.

* * * * *